US009890554B2

(12) United States Patent
Duncan, III

(10) Patent No.: US 9,890,554 B2
(45) Date of Patent: Feb. 13, 2018

(54) HANGING STRUCTURES HAVING ZOME GEOMETRY

(71) Applicant: Richard J. Duncan, III, Williams, OR (US)

(72) Inventor: Richard J. Duncan, III, Williams, OR (US)

( * ) Notice: Subject to any disclaimer, the term of this patent is extended or adjusted under 35 U.S.C. 154(b) by 786 days.

(21) Appl. No.: 14/266,416

(22) Filed: Apr. 30, 2014

(65) Prior Publication Data

US 2015/0030790 A1 Jan. 29, 2015

Related U.S. Application Data

(60) Provisional application No. 61/857,752, filed on Jul. 24, 2013.

(51) Int. Cl.

| | |
|---|---|
| ***E04H 15/04*** | (2006.01) |
| ***A47C 3/025*** | (2006.01) |
| ***A47C 17/84*** | (2006.01) |
| ***A45B 11/00*** | (2006.01) |
| *E04B 1/34* | (2006.01) |
| *A45B 23/00* | (2006.01) |

(52) U.S. Cl.

CPC ..... *E04H 15/04* (2013.01); *A45B 11/00* (2013.01); *A47C 3/0255* (2013.01); *A47C 17/84* (2013.01); *A45B 2011/005* (2013.01); *A45B 2023/0093* (2013.01); *E04B 1/34* (2013.01); *Y10T 428/13* (2015.01)

(58) Field of Classification Search

CPC ..... E04H 15/04; Y10T 428/13; E04B 1/34; A47C 3/0256; A47C 17/84; A45B 11/00; A45B 2011/005; A45B 2023/0093

See application file for complete search history.

(56) References Cited

U.S. PATENT DOCUMENTS

| | | | | |
|---|---|---|---|---|
| 1,411,272 A | | 4/1922 | Eaton | |
| 3,411,250 A | * | 11/1968 | Maymont | E04B 1/34 52/292 |
| 3,545,461 A | | 12/1970 | Carlson | |
| 3,722,153 A | | 3/1973 | Baer | |

(Continued)

FOREIGN PATENT DOCUMENTS

| | | |
|---|---|---|
| DE | 10333633 | 3/2005 |
| FR | 2911484 | 7/2008 |
| WO | 02/097211 | 12/2002 |

*Primary Examiner* — Michael C Miggins

(74) *Attorney, Agent, or Firm* — Jerry Haynes Law

(57) ABSTRACT

Hanging structure includes a structure frame, the structure frame having a substantially convex polyhedron shape, the structure frame comprising at least one facet, at least one level and a ratio; a plurality of compressive members being disposed to align along a substantially horizontal alignment on the structure frame and configured to absorb a compressive force, the plurality of compressive members further being disposed to delineate each of the at least one level; and a plurality of tensile members carrying the plurality of compressive members, the plurality of tensile members being disposed to align along a substantially vertical or diagonal alignment on the structure frame; and a plurality of moment resisting nodes defining attachment points between the plurality of compressive members and the plurality of tensile members.

19 Claims, 26 Drawing Sheets

(56) References Cited

U.S. PATENT DOCUMENTS

| | | | |
|---|---|---|---|
| 4,221,429 | A | 9/1980 | Wade |
| 4,526,307 | A | 7/1985 | Parker |
| 5,265,395 | A | 11/1993 | Lalvani |
| 5,494,066 | A | 2/1996 | McMahan |
| 5,522,186 | A | 6/1996 | Jarman |
| 5,528,849 | A | 6/1996 | Plinta |
| 6,220,264 | B1 | 4/2001 | Newman |
| 7,367,068 | B2 | 5/2008 | Huff |
| 2006/0181788 | A1 | 8/2006 | Harada et al. |
| 2006/0288950 | A1 | 12/2006 | Cartwright et al. |

* cited by examiner

HANGING STRUCTURES HAVING ZOME GEOMETRY

CROSS-REFERENCE TO RELATED APPLICATIONS

This application claims the benefit of U.S. provisional application No. 61/857,752, filed Jul. 24, 2013 and entitled HANGING STRUCTURES HAVING ZOME GEOMETRY, which provisional application is incorporated by reference herein in its entirety.

FIELD OF THE INVENTION

The present invention relates generally to a hanging structure. More particularly, the present invention relates to structures which have zome geometry and may be suspended from a suitable support to facilitate free movement of the structures.

SUMMARY OF THE INVENTION

Illustrative embodiments of the disclosure are generally directed to hanging structures for forming a scalable zome design. An illustrative embodiment of the hanging structures includes a structure frame, the structure frame having a substantially convex polyhedron shape, the structure frame comprising at least one facet, at least one level and a ratio; a plurality of compressive members being disposed to align along a substantially horizontal alignment on the structure frame and configured to absorb a compressive force, the plurality of compressive members further being disposed to delineate each of the at least one level; and a plurality of tensile members carrying the plurality of compressive members, the plurality of tensile members being disposed to align along a substantially vertical or diagonal alignment on the structure frame.

BRIEF DESCRIPTION OF THE DRAWINGS

Illustrative embodiments of the invention will now be described, by way of example, with reference to the accompanying drawings, in which:

FIG. 1A illustrates a six level hanging structure, FIG. 1B illustrates an exemplary five level hanging structure, and FIG. 1C illustrates an exemplary hanging structure carrying a load, in accordance with an embodiment of the present invention;

FIG. 3A illustrates a [8×6×1] variable ratio; FIG. 3B illustrates a [9×6×1] variable ratio; FIG. 3C illustrates a [10×6×1] variable ratio; FIG. 3D illustrates a [8×5×1] variable ratio; FIG. 3E illustrates a [8×6×1] variable ratio; FIG. 3F illustrates a [8×7×1] variable ratio; FIG. 3G illustrates a [8×6×0.5] variable ratio; FIG. 3H illustrates a [8×6×1] variable ratio; FIG. 3I illustrates a [8×6×2] variable ratio; and FIG. 3J illustrates a [8×6×3] variable ratio.

Like reference numerals refer to like parts throughout the various views of the drawings.

DETAILED DESCRIPTION OF THE INVENTION

Figure 1A:
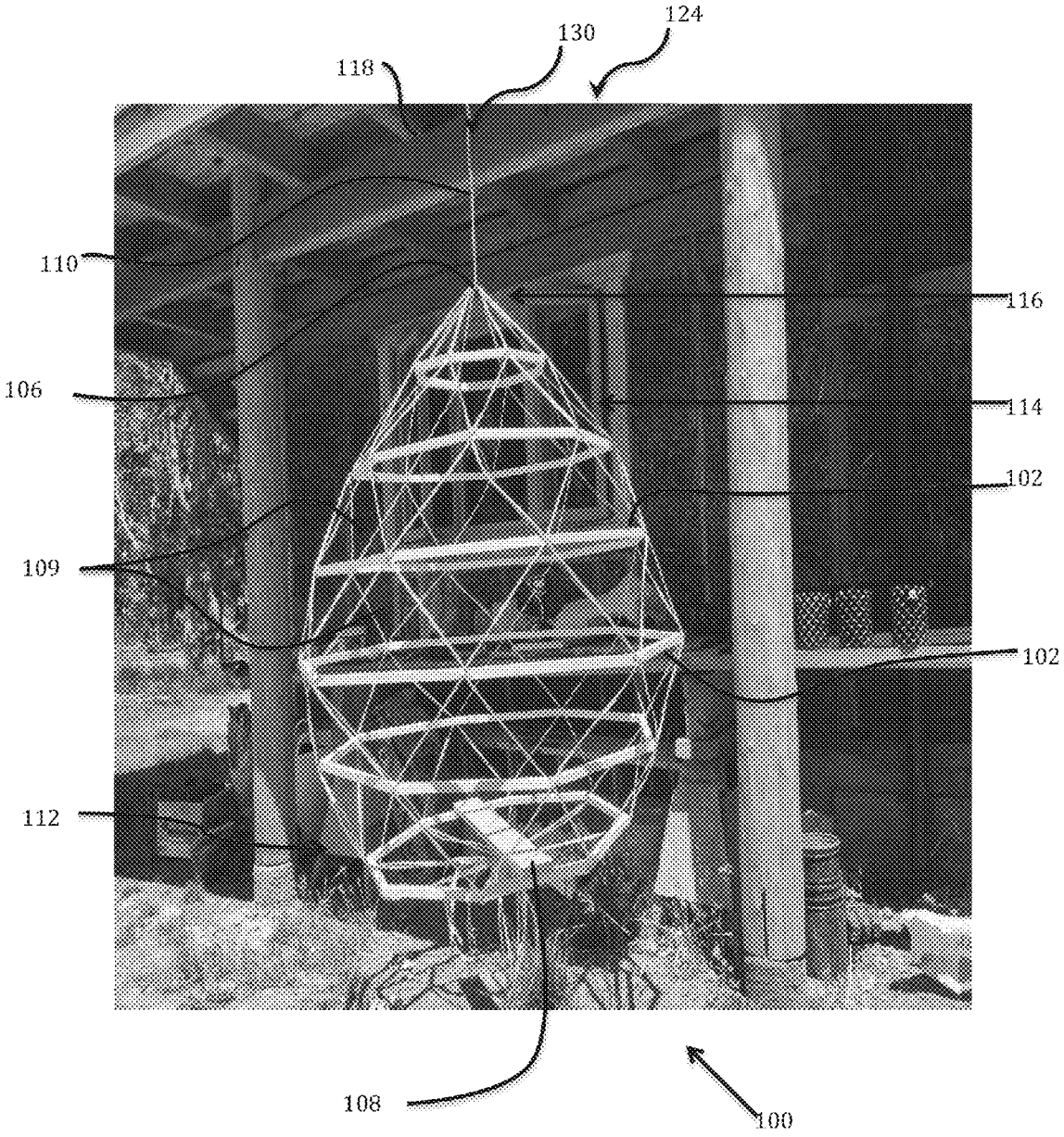
FIGS. 1A, 1B, and 1C illustrate detailed perspective views of exemplary hanging structures, where
Figure 1B:
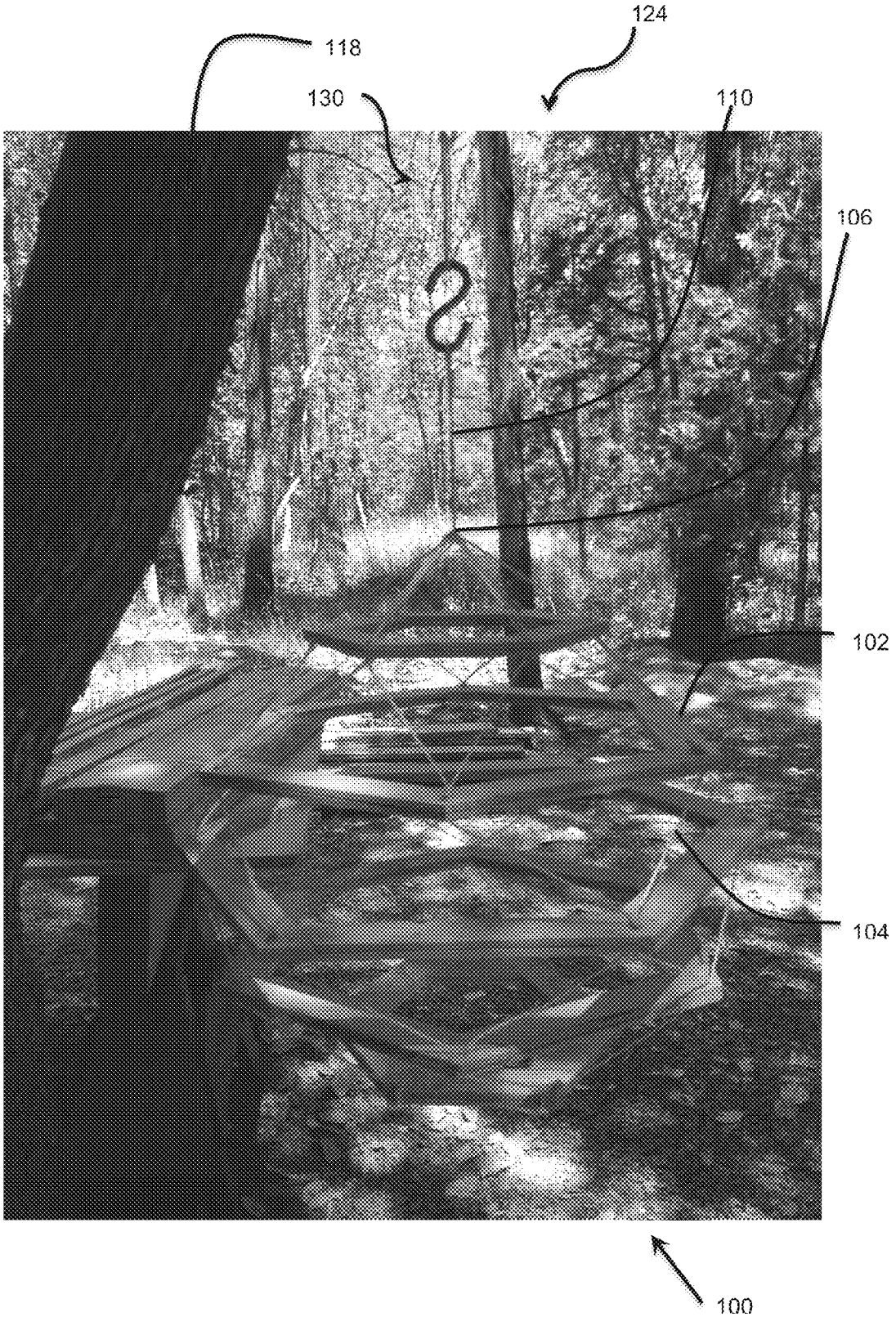
Figure 1C:
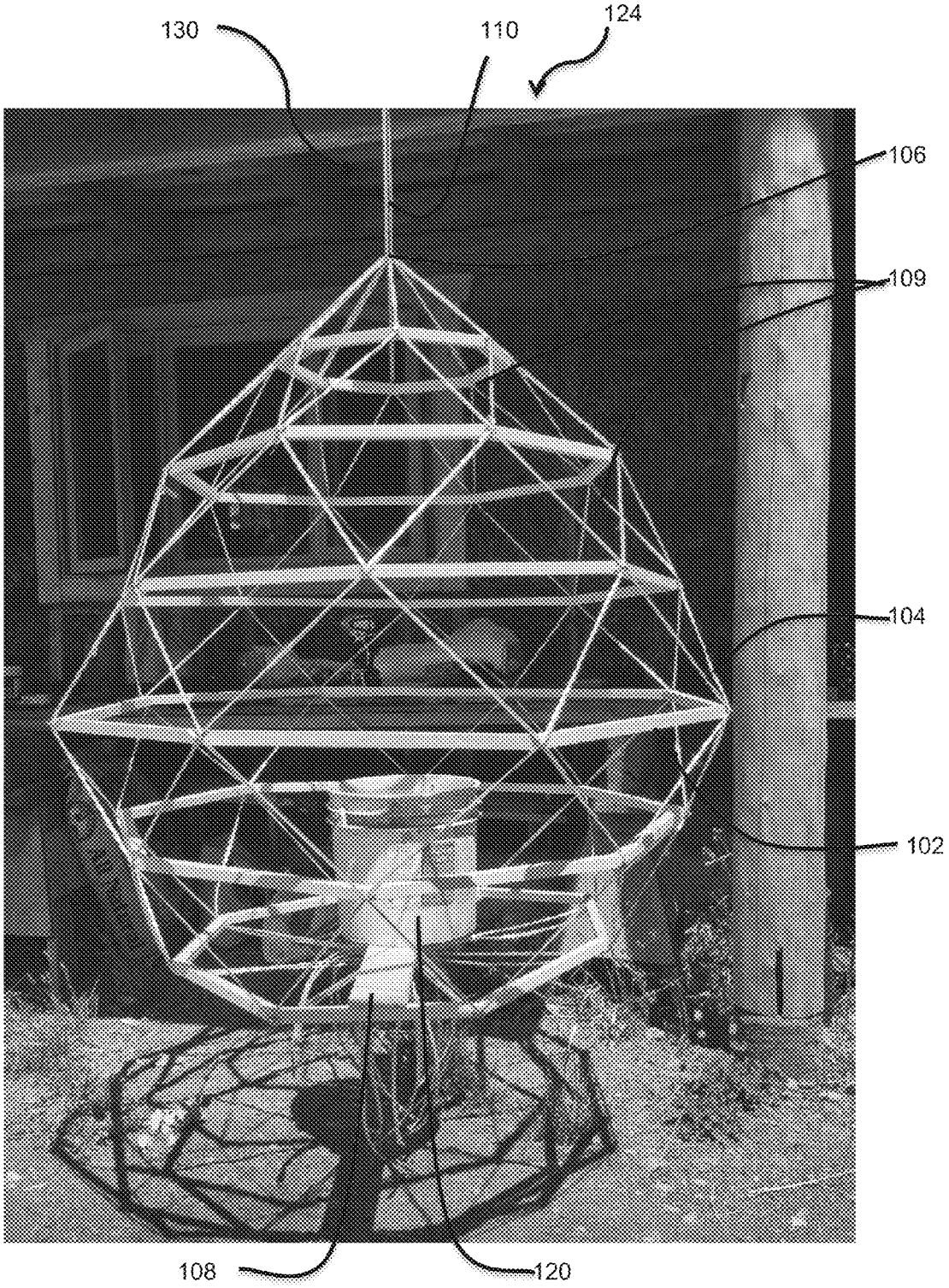
Figure 2:
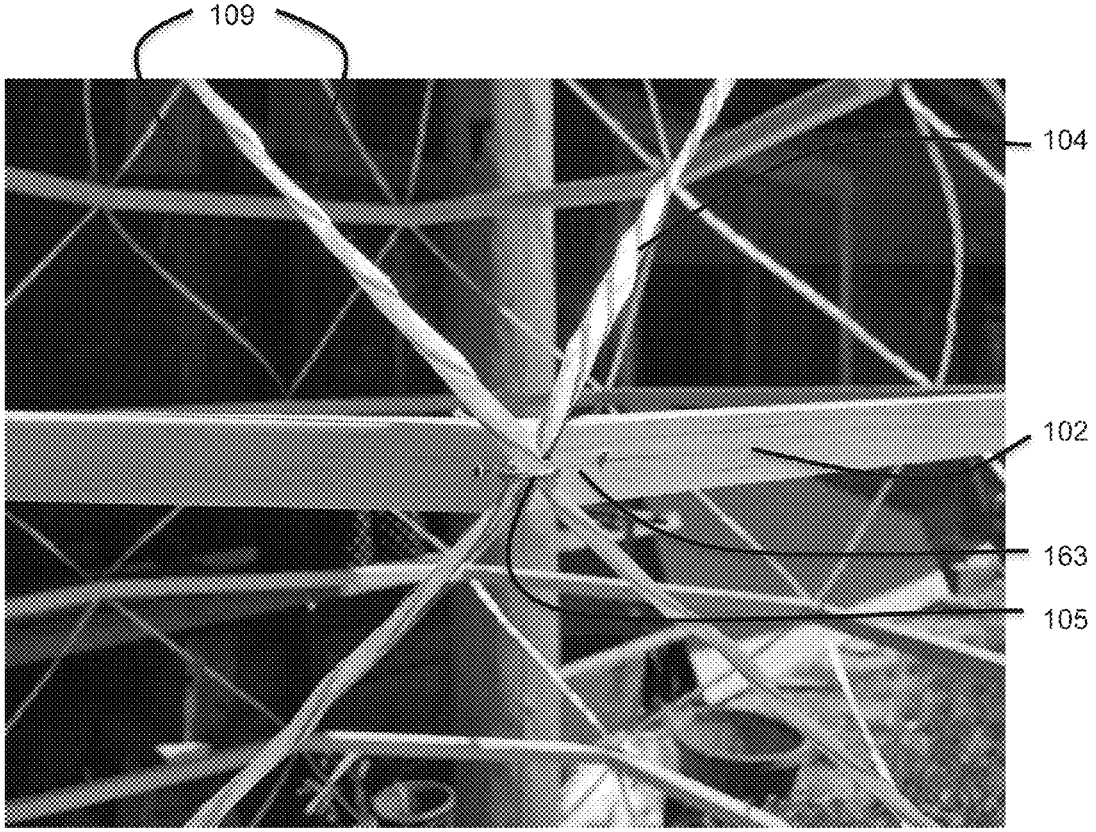
FIG. 2 presents a close up view of an exemplary fastener attaching an exemplary tensile member to an exemplary compressive member, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIGS. 1A-1C. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A hanging structure is described in FIGS. 1A through 3J. The hanging structure 124 may include a structure frame 100. A suspension assembly 130 may attach the structure frame 100 to support line 110. The structure frame 100 may be configured to provide a structure having a substantially convex polyhedron shape. The structure frame 100 may include at least one facet 109, at least one level and a ratio. The structure frame 100 may include a plurality of compressive members 102, the plurality of compressive members 102 being generally parallel and spaced-apart along a vertical axis and disposed to align along a substantially horizontal alignment on the structure frame 100. The plurality of compressive members 102 may further be disposed to delineate each level of the structure frame 100. In some embodiments, each of the plurality of compressive members 102 may include a rigid horizontal ring which is configured to absorb a compressive force applied to the structure frame 100.

The structure frame 100 may further include a plurality of tensile members 104, the plurality of tensile members 104 being disposed to align along a generally vertical or diagonal alignment on the structure frame 100. In some embodiments, each of the plurality of tensile members 104 may include one or more cords configured to resist a tensile force applied to the structure frame 100. The tensile members 104 may be configured to intersect the plurality of compressive members 102 at at least one node 163. Multiple nodes 163 may be spaced around the circumference or perimeter of each compressive member 102. The structure frame 100 may further include at least one fastener 105 for joining the plurality of compressive members 102 with the plurality of tensile members 104 at each node 163. Multiple facets 109 may be formed by and between the compressive members 102 and the tensile members 104. The structure frame 100 may further include a frame upper section 114, the frame upper section 114 having at least one support point 106 which is configured to join with a support line 110 for suspending the structure frame 100 from an external support structure 118. The structure frame 100 may further include a frame lower section 112 having a base 108 which is configured to support a load 120 inside the hanging structure 124.

In some embodiments, the hanging structure 124 may be directed to a free moving, suspended structure that conforms to principles of zome geometry to provide a variety of novel functions and designs.

The hanging structure 124 may attach to an elevated external support structure 118 through a support line 110 such as a cord, for example and without limitation. The support line 110 may join with the hanging structure 124 from at least one support point 106 on the hanging structure 124. In this manner, a gravitational force may pull and extend the hanging structure 124 downwardly, creating tension on the support line 110.

In some embodiments, the hanging structure 124 may move freely in alternate directions or in either direction around a fixed point. The free movement of the hanging structure 124 may include, for example and without limitation, lateral, oscillating, swaying to and fro, and a swinging path. However, additional free movement paths of the hanging structure 124 may be utilized based on the location of the attachment with the support line 110, the dimensions of the hanging structure 124 and the length of the support line 110. External factors, such as wind and movement form the external support structure 118 may also affect the free movement of the hanging structure 124.

Those skilled in the art will recognize that the free movement created by suspending the hanging structure 124 provides greater flexibility than with a rigidly attached structure. This flexibility serves to help minimize damage to the hanging structure 124. The flexibility may also facilitate more functional uses for the hanging structure 124. In some embodiments, the multifaceted, convex patterns, and pointed terminal points of the hanging structure 124 may provide additional support points 106 for hanging the hanging structure 124. As additional support lines 110 join with the hanging structure 124, the flexibility and free movement may become more restricted and increase in strength and structural integrity. In this manner, the free movement of the hanging structure 124, and the rigidity of the hanging structure 124 itself, may be adjusted as desired.

In some embodiments, the hanging structure 124 may be suspended from any elevated external support structure 118 having sufficient strength, including, without limitation, a tree branch, rope string between two trees, a man-made support structure, a tripod, a roof beam, and another hanging structure 124. The hanging structure 124 may also be formed around the external support structure 118, such as a tree, a flag pole, and a center post, whereby the free play of suspension is reduced, yet movement and flexibility for the hanging structure 124 in relation to the external support structure 118 still exist.

In some embodiments, the hanging structure 124 may utilize a zome geometric pattern to form a three dimensional structure frame 100. The structure frame 100 may create a defined space that suspends above a ground surface. Those skilled in the art will recognize that the structure frame 100 may be a zonohedron having a substantially dome shape to create space and structure in terms of volume rather than points, lines or planes. The zonohedron may include a convex polyhedron having multiple facets 109, where each facet 109 comprises a polygon with point symmetry, or equivalently, symmetry under rotations through 180°. In this manner, the structure frame 100 may include regular polygons having equal face angles and equal edge lengths that meet identically at each vertex.

Nonetheless, despite the regular symmetry of the structure frame 100, the concave, polyhedral shape of the zonohedron may result in a structure frame 100 having unorthodox or unusual shapes and spaces. These unusual geometries may differ significantly from a standard building structure comprised of a series of rectangular boxes. These unusual geometries are efficacious for providing greater flexibility in functionality and aesthetics for the hanging structure 124 than a standard planar structure might otherwise provide. In some embodiments, the structure frame 100 may include irregular polygons lacking the symmetry of regular polyhedra.

In some embodiments, the polyhedral shapes utilized by the structure frame 100 may include, for example and without limitation, a tetrahedron composed of four equilateral triangles with three triangles meeting at every vertex; an octahedron composed of eight equilateral triangles with four triangles meeting at every vertex; a cube composed of six squares with three squares meeting at every vertex; an icosahedron composed of twenty equilateral triangles with five triangles meeting at every vertex and; and a dodecahedron composed of twelve regular pentagons with three pentagons meeting at every vertex.

In some embodiments, the zome geometric pattern of the hanging structure 124 may follow mathematical equations. The mathematical equations are recognized by those skilled in the art as zome geometry, which is essentially the geometry of three dimensional spaces. These equations may be manipulated to alter the dimensions of the structure frame 100.

In some embodiments of the hanging structure 124, the size and dimension of the structure frame 100 may be formed and manipulated by altering any of three components. The components may include facets, levels, and ratios. The combinative effect of all three components may be altered through a variable ratio. The capability to adjust any of these components may allow the hanging structure 124 to have scalability. The scalability may allow the hanging structure 124 to increase in size without compromising structural integrity.

In some embodiments, each facet 109 may be a polygon having point symmetry. The level refers to the hanging structure 124 as a whole. The hanging structure 124 may be separated into various sections, or levels, along a longitudinal axis. The ratio refers to the relative size of the facet 109. Those skilled in the art will recognize that these variables may form a synergy and may be interdependent on each other to create the final shape and dimension of the structure frame 100. The variables may be mathematically represented as follows:

[Facet]×[Level]×[Ratio], or, for example, [8×6×1].

Figure 3A:
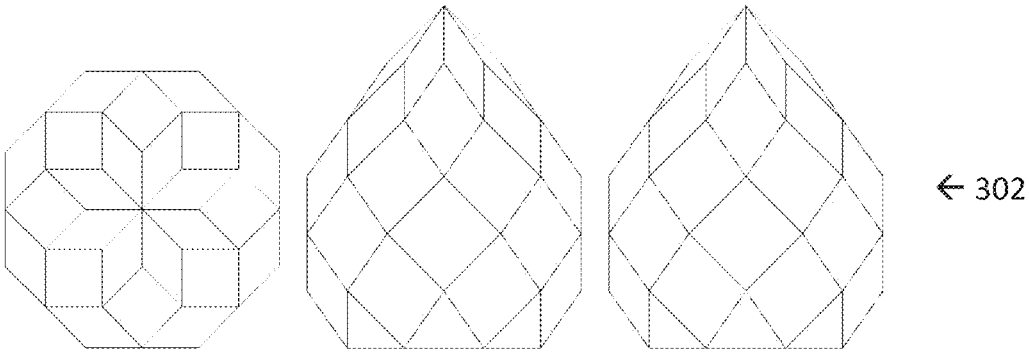
FIGS. 3A-3J illustrate top views and plan views of exemplary hanging structures having variable facets, levels, and ratios, where
Figure 3B:
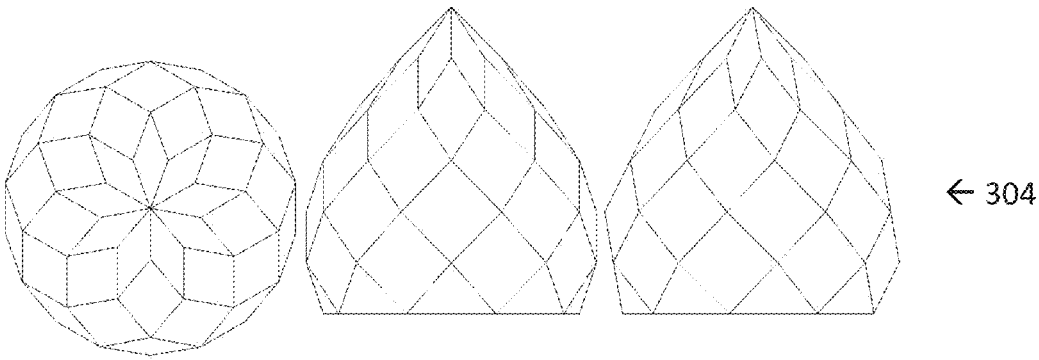
Figure 3C:
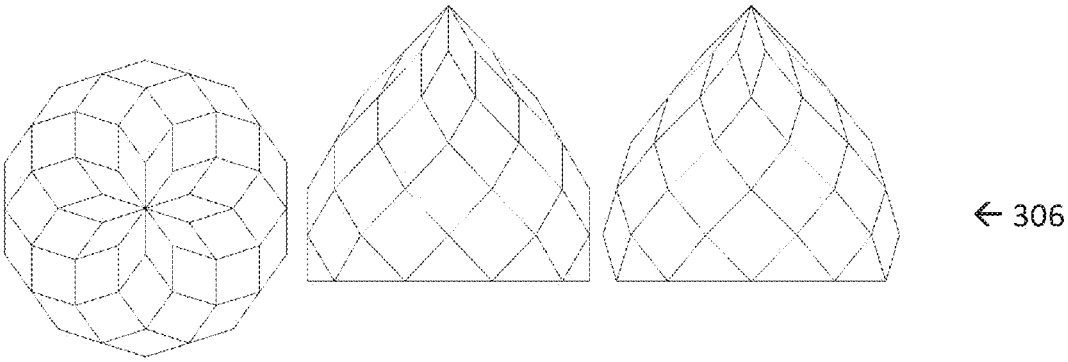
Figure 3D:
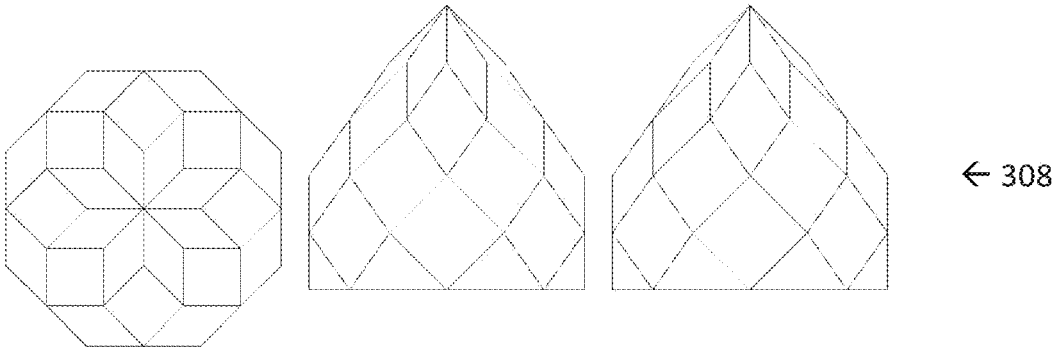
Figure 3E:
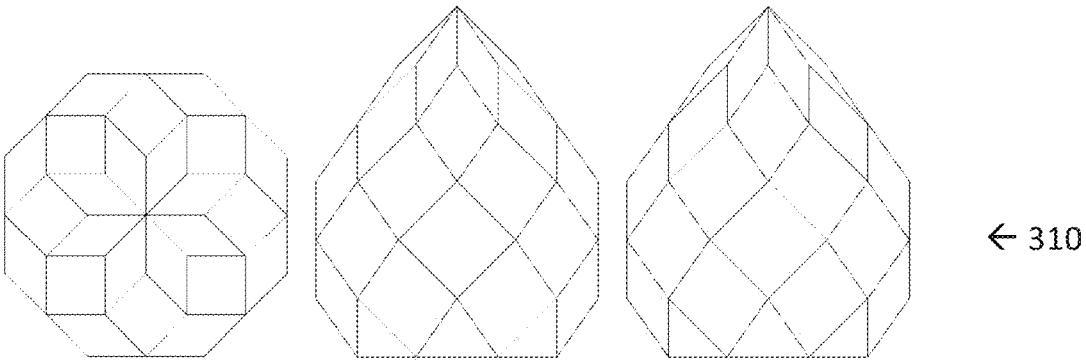
Figure 3F:
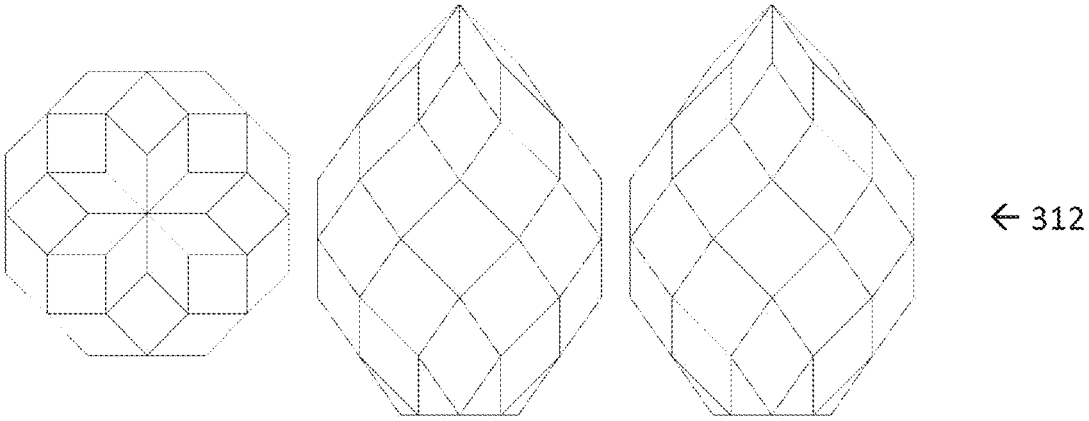
Figure 3G:
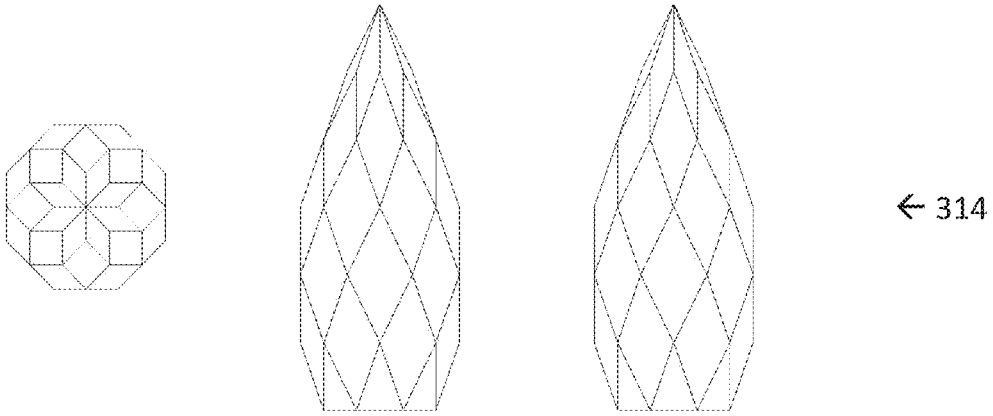
Figure 3H:
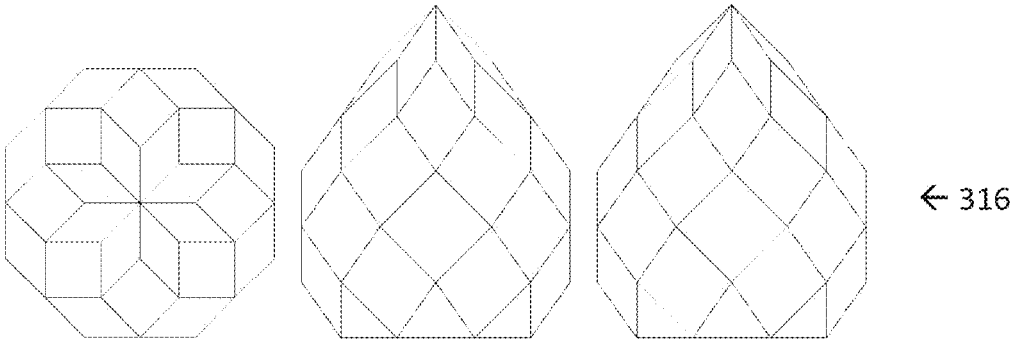
Figure 3I:
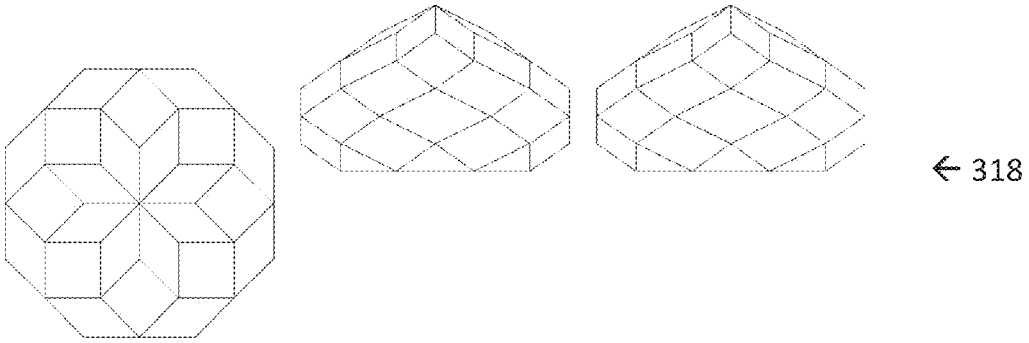
Figure 3J:
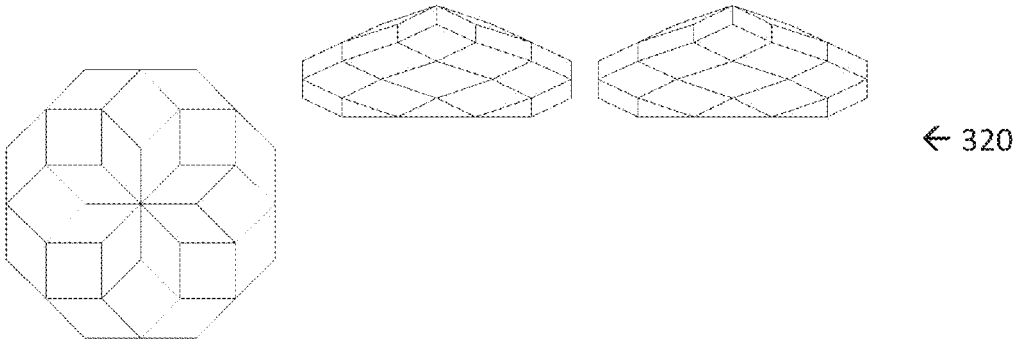
Figure 4:
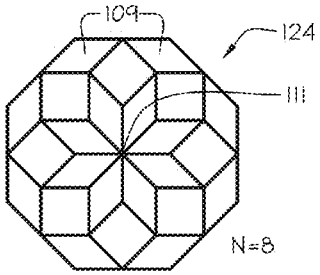
FIG. 4 is a top view of a typical zome configuration having 8 facet divisions and which is suitable for implementation of the hanging structures.
Figure 4A:
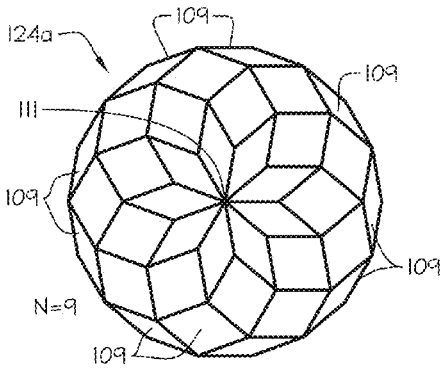
FIG. 4A is a top view of an alternative typical zome configuration having 9 facet divisions and which is suitable for implementation of the hanging structures.
Figure 5:
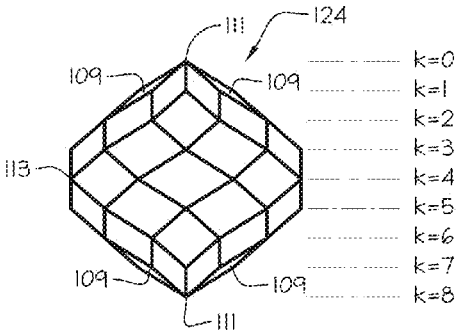
FIG. 5 is a side view of the zome configuration illustrated in FIG. 4.
Figure 5A:
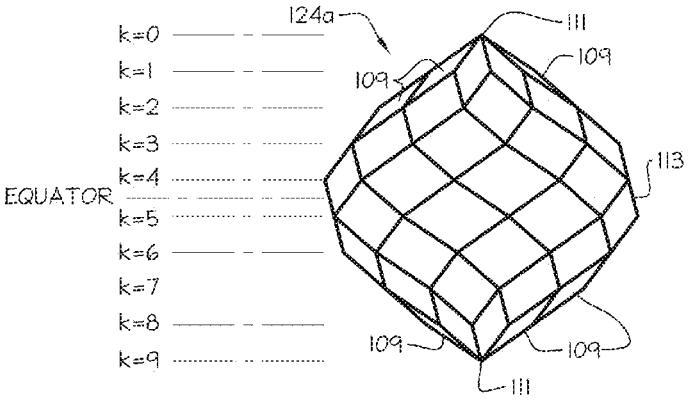
FIG. 5A is a side view of the zome configuration illustrated in FIG. 4A.

From a plan view, as referenced in FIG. 3A, the above variable ratio represents a structure frame 100 having 8 polygons, 6 levels, and each polygon having a ratio of 1, or [8×6×1] 302. The number of facets 109 may be increased or decreased in the structure frame 100, thereby increasing or decreasing the overall size of the hanging structure 124. This facility allows the hanging structure 124 to be scalable. Those skilled in the art will recognize that increasing the size of the hanging structure 124 by adding facets 109 causes the structural system to become more redundant with reinforcement elements, which increase strength and safety. This contributes to the effective scalability of the hanging structure 124. The number of facets 109 can also be increased without compromising structural integrity due to the zome geometry, flexibility, compressive resistance, tensile resistance, and force equalizing fasteners 105. Example of these variable ratios are referenced in FIGS. 3A-3C, and include a [9×6×1] 304, and [10×6×1] 306.

In some embodiments, the number of levels of the hanging structure 124 can be increased or decreased. The levels can have equal or unequal lengths. Any of the levels, either individually, or in conjunction, can be shortened or lengthened to adjust the length of the structure frame 100 as a whole. Example of these variable ratios are referenced in FIGS. 3D-3F, and include a [8×5×1] 308, [8×6×1] 310, and [8×7×1] 312.

In some embodiments, the ratio can be manipulated, with a ratio less than 1 providing a more slender structure frame 100, and a ratio greater than 1 providing a wider structure frame 100. Example of these variable ratios are referenced in FIGS. 3G-3J, and include a [8×6×0.5] 314, [8×6×1] 316, and [8×6×2] 318, and [8×6×3] 320.

In some embodiments, the structure frame 100 may include vertical and horizontal members that attach together to provide tensile and compressive integrity to the hanging structure 124. A plurality of compressive members 102 may be disposed to align along a substantially horizontal alignment in the structure frame 100. In some embodiments, the plurality of compressive members 102 may include rigid horizontal rings configured to absorb inward, or compressive forces. The rigidity of the compressive members 102 may help to resist deformation and stress from the weight of the structure frame 100 and a load 120 inside the structure frame 100. The compressive member may include rings that completely encompass the structure frame 100 and form the different levels, whereby each compressive member delineates two levels. The length of the levels can be adjusted by spacing the plurality of compressive members 102 accordingly. The plurality of compressive members 102 may also be segmented, or faceted into straight lines between at least one node 202. Suitable materials for the plurality of compressive members 102 may include, without limitation, wood, high density polymers, steel, metal alloys, and fiberglass.

In some embodiments, a plurality of tensile members 104 may be disposed to align along a substantially vertical or diagonal alignment in the structure frame 100. The plurality of tensile members 104 may include flexible cords configured to resist outwardly pulling forces that attempt to pull the tensile members 104 apart. The flexible properties of the tensile members 104 may provide additional free play to the structure frame 100 and allow for the support of the load 120. The plurality of tensile members 104 may also help support and space the plurality of compressive members 102. For example and without limitation, the plurality of tensile members 104 and compressive members 102 may join to form a stable skeleton structure frame 100 of a having teardrop shape. Suitable materials for the plurality of tensile members 104 may include, without limitation, polycord, rope, chains, rubber, elastic cords, bamboo, wood, and nonwoven materials.

The levels that layer the structure frame 100 may be adjustable. Any of the levels, either individually, or in conjunction, may be shortened or lengthened to adjust the length of the structure frame 100 as a whole. For example, without limitation, the plurality of tensile members 104 between a level 3 and a level 4 may be lengthened to give the hanging structure 124 a long waist. The plurality of compressive members 102 may also be brought into proximity to shorten a level. In another configuration, two hanging structures 124 having a substantially convex shape may stack atop each other to create a double zome or hourglass shape.

In some embodiments, a substantially horizontal, planar base 108 positions on a frame lower section 112. The base 108 provides a surface for the load 120 to rest within the structure frame 100. The base 108 may attach to the structure frame 100 or to an external support structure 118 that positions independently of the structure frame 100. The plurality of tensile members 104 may attach to the base 108 and loop back up, towards a frame upper section 114. In some embodiments, the frame lower section 112 may extend to a full point, or be placed horizontally at any level of the zome geometry.

In some embodiments, at least one support point 106 may be provided on the frame upper section 114. The at least one support point 106 may provide a junction for receiving the support line 110 from above the structure frame 100. The at least one support point 106 may be positioned at a frame apex 116 or at any point along the frame upper section 114. The at least one support point 106 may include, without limitation, a ring, a hook, a rod, a magnet, and an anchoring member.

The plurality of tensile members 104 may intersect with the plurality of compressive members 102 at at least one node 163, forming a substantially perpendicular junction. In some embodiments, at least one fastener 105 secures the plurality of compressive members 102 to the plurality of tensile members 104 at each moment resisting node 163. Those skilled in the art will recognize that the at least one fastener 105 shaped as a ring may self-equalize, center, and evenly distribute the compressive and tensile forces that form at each moment resisting node 163. This equal distribution of weight and forces help the hanging structure 124 to carry loads more efficiently. Other suitable fasteners 105 may be used to secure the plurality of compressive members 102 to the plurality of tensile members 104. These fasteners 105 may include, for example and without limitation, nails, screws, sleeves, slides, rings, hooks, clips, staples, ropes, adhesives, magnets, and nonwoven materials. In one alternative embodiment, the plurality of compressive members 102 and the plurality of tensile members 104 may join by snapping or sliding together, without the use of the at least one fastener 105. The fastener 105 may also capable of resisting moment (torsional) forces. This type of fastener system, combined with the substantially vertical elements also being able to resist moment forces, thereby eliminates purely horizontal, compressive elements.

In some embodiments, the structure frame 100 may include at least one aperture for providing, without limitation, doors, windows, and spaces throughout the structure frame 100. The at least one aperture does not compromise the integrity of the structure frame 100. Adequate transfer forces around the aperture are readily obtained by combining tensile and compressive elements, or moment resisting elements. The structure frame 100 may further be covered with at least one canopy (not illustrated). The at least one canopy may be easily detachable from the structure frame 100 and interchangeable. Each canopy may have canopy panels which are sized to match a single facet 109 or cover the whole structure frame 100. Suitable materials for the at least one canopy may include, for example and without limitation, wood, metal, rigid plastic, silicone, canvas, fabric, and mesh. Those skilled in the art will recognize that the interchangeable aspect of the at least one wall increases the functionality of the hanging structure 124. For example, without limitation, mesh may be utilized during hot weather, and a solid fiberglass panel may be utilized during cold weather, serving as a barrier to the cold.

The structure frame 100 may thereby form a defined space suspended from the ground, which provides both functional and aesthetic uses for the hanging structure 124. For example and without limitation, the hanging structure 124 may include a geometrically zome-shaped chair that suspends from an elevated horizontal beam, whereby a user may swing freely while sitting in the zome chair. In yet another example, the hanging structure 124 may at least partially encompass a tree trunk. An inner, open area of the hanging structure 124 then has sufficient free play to swing and rotate around and with the tree, yet also remain within proximity of the tree. Additional uses for the hanging structure 124 may include, without limitation, a novel chair, a hang-out area, an elevated storage, a sleeping platform, a suspended couch, a housing structure, a living area, a residence, a hanging merry-go-round structure, a hanging climbing structure for playgrounds, and an integrated tree house that encircles a tree trunk.

In some embodiments, the hanging structure 124 may be utilized as a beehive. The hanging structure 124 may provide a more natural shape and structure than the typical bee box. The zome beehive may be suspended, covered in fabric and clay mud, and the structure frame 100 top section may detach from the structure frame 100 lower section 112 to provide access to a hanging honey comb panel within. The structure frame 100 may also be sectional, having interchangeable sections connecting at each horizontal ring. This structure may impart flexibility to the beehive shape to facilitate the needs of the hive, that is, longer "middle" section for hanging comb and taller "top" section to provide a brooding chamber, etc.

In some embodiments, the hanging structure 124 may be configured in a tree, as a tree house. In this configuration, the hanging structure 124 may not be suspended from the support line 110, but may rather encompass the tree. The hanging structure 124 may be cut horizontally at A top level to remove the apex 116. The zome tree house may be assembled around the tree, forming an enclosed cocoon that can position higher on the tree than any other type of structure. The geometry of the zome tree house may allow it to be more dynamic in its response to wind and tree movement, lightweight yet spacious, and capable of connecting to the tree using bolts. The bolts may be used to hang cables from, and can be placed in a position optimized by the tree's needs, rather than the hanging structure's needs.

In some embodiments, the hanging structure 124 may include a suspended chair. The suspended chair may be ergonomic with an efficient back support angle and spaciousness due to the flexible nature of zome geometry, and can be utilized both indoors and outdoors. The horizontal plurality of compression members, in the form of rings, may have a double use as a shelf and armrest. The base 108 may serve as the actual seat with an extendable leg support, thus allowing for a lounge chair. Access to the hanging structure 124 would be through the aperture in the side of the hanging structure 124, and therefore additional structural elements, mainly compression members, would have to define the opening and transfer loads. In yet another embodiment, the hanging structure 124 may be utilized as a suspended love seat, lounge, or bed. The suspended love seat/lounge/bed may be similar to the hanging chair, except it has increased width. The hanging bed may be spacious inside, rather than a confining and claustrophobic conical shape.

In some embodiments, the hanging structure 124 may further be formed as a hanging tent that provides shade and an insect screen for camping and outdoor recreational activities. The hanging tent may be permanent or temporary. The hanging tent may assemble and dissemble quickly and may be used for car camping or backpacking structures.

In some embodiments, the hanging structure 124 may form an umbrella, or sun shade. The hanging structure 124 may be cut horizontally at a level in the structure frame 100 upper section 114, thereby creating a shallow umbrella which is efficacious to serve as a sun shade on a patio and to receive lighting, making it an outdoor decorative ornament. The zome umbrella may hang from a cable above or from a center support post underneath the hanging structure 124.

Those skilled in the art, in light of the present teachings, will recognize that myriad combinations of the above hanging structures 124 may be combined to form additional structures. For example and without limitation, the zome umbrella may be fixed on a rotating center pole. Each node 163 along the edge of the zome umbrella may attach to a zome chair. This arrangement may produce a zome-shaped merry-go-round. Additionally, the hanging structure 124 may be utilized to form a playground, a climbing structure, a trampoline, or an amusement ride.

In some embodiments, the compressive members 102 of the hanging structure 124 may serve as a type of spring or shock absorber providing that with any structure movement, the springs or shock absorber will be displaced. At these displacement points, electric generation could occur using techniques such as by simple magnets, wrapped coils, linear displacements, or other electrical generation systems known in the art. The entire hanging structure 124 may have a defined use as described above, but also may provide a framework for an energy generating device.

A first aspect of the present invention provides a hanging structure 124 that comprises a substantially convex polygon and dome configured to conform to the mathematics and laws of zome geometry.

In a second aspect, the hanging structure 124 may be scalable. The hanging structure 124 may have any number or quantity of facets 109, levels and ratios to increase or decrease its size. The zome geometry, flexibility, compressive resistance, tensile resistance, and force equalizing fastener 105 may allow the hanging structure 124 to retain structural integrity even after the size and dimension has increased.

In another aspect, the variable ratio changes the number of facets 109 and/or levels and/or the ratio in the structure frame 100. In this manner, the shape and dimension of the structure frame 100 may be altered.

In another aspect, the hanging structure 124 may be suspended from an external support structure 118 by at least one support point 106, usually, but not necessarily, from the frame upper section 114.

In yet another aspect, the plurality of compressive members 102 may include rigid horizontal rings which are configured to absorb inward or compressive forces. The rigidity of the compressive members 102 may help resist deformation and stress from the weight of the structure frame 100 and any object inside the structure frame 100.

In yet another aspect, the hanging structure 124 may include flexible cords configured to resist outwardly pulling forces that attempt to pull the tensile members 104 apart. The flexible properties of the tensile members 104 may provide additional free play to the structure frame 100 and allow for the support of heavier loads 120.

One benefit of the hanging structure 124 is that the zome geometry allows the hanging structure 124 to provide both functions and aesthetics. The functions depend on the flexibility and space provided through zome geometry and allow for carrying the load 120. The aesthetics are based on the polygonal facets 109, which may include numerous unusual designs.

Another benefit of the hanging structure 124 may include relatively low maintenance and manufacturing costs.

Yet another benefit of the hanging structure 124 may include the capacity to either hang from an external support structure 118 or be built around a vertical external support structure 118 such as a tree, for example and without limitation.

Figure 6:
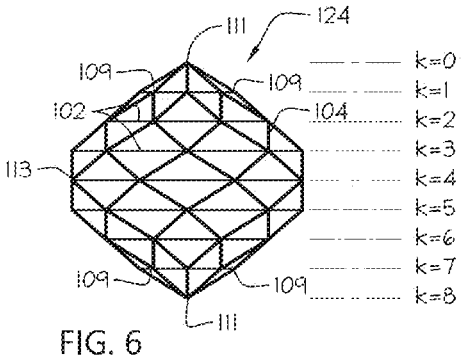
FIG. 6 is a side view of the zome configuration illustrated in FIG. 4 with the nodes triangulated for enhanced structural stability.
Figure 6A:
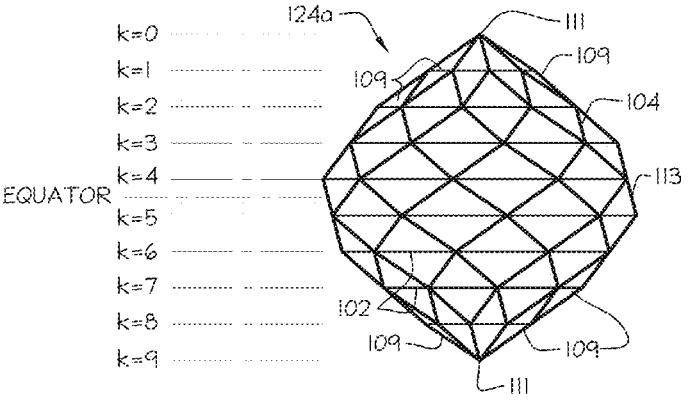
FIG. 6A is a side view of the zome configuration illustrated in FIG. 4A with the nodes triangulated for enhanced structural stability.

Referring next to FIGS. 4-6A of the drawings, a first hanging structure 124 and a second hanging structure 124*a* are illustrated. The first hanging structure 124 has 8 facet divisions 109 (n=8), and the second hanging structure 124*a* has 9 facet divisions 109 (n=9). Each level is labeled (k), with the top most level being level 0. The n=8 zome has an equator 113 at level 4 and ends at k=8, while the n=9 zome has an equator 113 at level 4.5 and ends at k=9. Unless all members and connections can resist compressive, tensile, and moment forces, the structure itself at this point is unstable, as each facet 109 is a diamond shape. As illustrated in FIGS. 6 and 6A, bisecting each facet 109 with horizontal members 102 results in each diamond facet 109 being divided into equal triangular pieces, and the resultant triangulation provides potential for inherent structural stability. By suspending the hanging structure 124 from above, the hanging structure 124 uses gravity to help form the shape of the hanging structure 124. This method of structural engineering is incredibly efficient, as the hanging structure 124 requires no strength to resist gravity, and instead uses the force of gravity as a structural component that adds to the structural strength. Similar to how a suspension bridge can span large distances with minimal structure, so too does the hanging structure 124 work with, rather than against, gravity.

With the triangulated facets 109, it can now clearly be seen that when suspended from above, the substantially vertical/diagonal elements 104 need only resist tensile forces. This allows this material to be collapsible, such as rope, webbing, wire cable, metal chain, etc. Each horizontal compressive member 102 is then essentially a compression ring, "pushing" outward from the hollow center of the hanging structure 124. While the compressive members 102 may also resist some bending and tensile forces, especially below the equator where greater tensile forces may occur, they can for the most part be considered compression rings. This combination of the purely tensile members 104, and substantially horizontal compression members 102, and bending moment resisting nodes 163, and bound by the top and bottom tension rings 111, comprise the basics of the zome shaped structural suspended system.

At the top and bottom (level 0 and level k=n) of the hanging structure 124, a tension member 111 connects all of the tensile members 104. At level 0 (FIGS. 6 and 6A), this tension member 111 equalizes all horizontal forces and transfers all of the vertical (gravity) load to the anchor point above.

The combination of the entirely tensile members 104 and the mostly compressive members 102 result in an incredibly minimal and efficient structure. These two elements may be connected together at each zome moment resisting node 163. This connection ensures that the hanging structure 124 maintains its zome shape and provides structural strength and stability. The fastener 105 at each zome node 163 may include at least one slide, strap, carabineer, welded ring and/or any other suitable fastening mechanism or device known by those skilled in the art.

From the full zome shape, the hanging structure 124 may be "sliced" in many directions. The most simple and useful of these slices occurs horizontally, where then only the upper portion of the hanging structure 124 remains. The horizontal bottommost layer of the remaining hanging structure 124 may then be reinforced to resist compressive, tensile, and bending forces. Once reinforced, this bottom then may stay open to below, creating a covering or umbrella shape. If horizontally "sliced" below the equator, this bottommost layer must take the place of and resist the forces of the bottom tension ring 111. If a solid floor is placed at this horizontal cut, then the hanging structure 124 may easily hold objects, including people, and can then include such embodiments as furniture, relaxation spaces, rooms, and houses. When an opening is "sliced" in the side of the hanging structure 124, then again this slice must be reinforced and creates a side opening such as doors, windows, etc.

In summary, using zome equations, 3D coordinates or nodes 163 are determined and a shape is defined. Each level of nodes 163 is connected to the adjacent node level in a zigzag pattern. This zigzag pattern is the location of the tension only structural elements. Then, triangulating the diamond pattern that is formed by these tensile elements with a rigid horizontal structural member, a compression ring is formed, and created the basis of the structural system. The rigid node connections 163 where each tensile member 104 intersects with a compressive member 102 may use a variety of connections, with several embodiments described in this patent. As with many suspended structures, the hanging structure 124 may use the force of gravity as a structural component. This use of gravity concept allows for hanging structures 124 to be extremely efficient and have large strength-to-weight ratios. This suspended zome structural system may be able to support its weight as well as the weight of occupants and objects. From a hanging lampshade to a hanging house, the system is scalable, redundant and efficient.

The hanging structure 124 creates the possibility for a truly tension-only structural element. The tension-only element, usually located on the outside of the compressive members 102, may be rope, webbing, chain, etc. or can also form a "skin" around the hanging structure 124, such as in a full exterior covering or canopy. This canopy in tension pushes on the skeletal structure below, which are the compressive members 102. Just as the atmosphere exerts pressure on skin, the skin pushes inward into the body. The bones of the skeletal system push back against the skin, thereby giving the shape and form to the body. The skin may be considered the tensile canopy covering 104, while the bones may be considered the compressive member 102 and nodes 163. The border of the openings in the hanging structure 124 may require additional force-resisting elements. This facility may allow for an embodiment of the hanging structure 124 in which the outer covering or canopy becomes the tensile members 104. High-performance fabrics such as a para-aramid synthetic fiber (KEVLAR), for example and without limitation, may be used to create an ultra-durable and strong collapsible hanging structure 124. In some embodiments, the tensioning canopy may also be located on the inside of the compression members 102 as an exoskeleton, having a strap or other type of tensile member connector connecting at each node 163.

A lower center of gravity of the hanging structure 124 provides correctly balanced mass for pendulum inertia. The hanging structure 124 may be fabricated with redundant structural components such that if any one component fails, the other components will compensate. For example and without limitation, the n=8 hanging structure 124 has 16 separate tensile members 104. As the system scales larger, the number of facets 109 may be increased, keeping member lengths short and increasing redundancy. For example and without limitation, an n=16 hanging structure 124 will have 32 tensile members 104, and each compressive member 102 may be divided to 16 segments. In some embodiments, the hanging structure 124 may be easily disassembled, allowing for packaging and shipping via UPS or other courier service. This ability to be easily shipped allows embodiments suitable for commercial sales and distribution.

The hanging structure 124 may use gravity itself as part of the structural system. Thus, rather than using members to resist gravity forces and balancing effects, suspension of the hanging structure 124 from above may utilize gravity to self-center and self-right the hanging structure 124. Thus, the hanging structure 124 requires only the tensile members 104 to resist this gravity. The rest of the hanging structure 124 may merely maintain the shape of the hanging structure 124 while the tensile members 104 resist gravity, which helps form the shape of the hanging structure 124.

Figure 8:
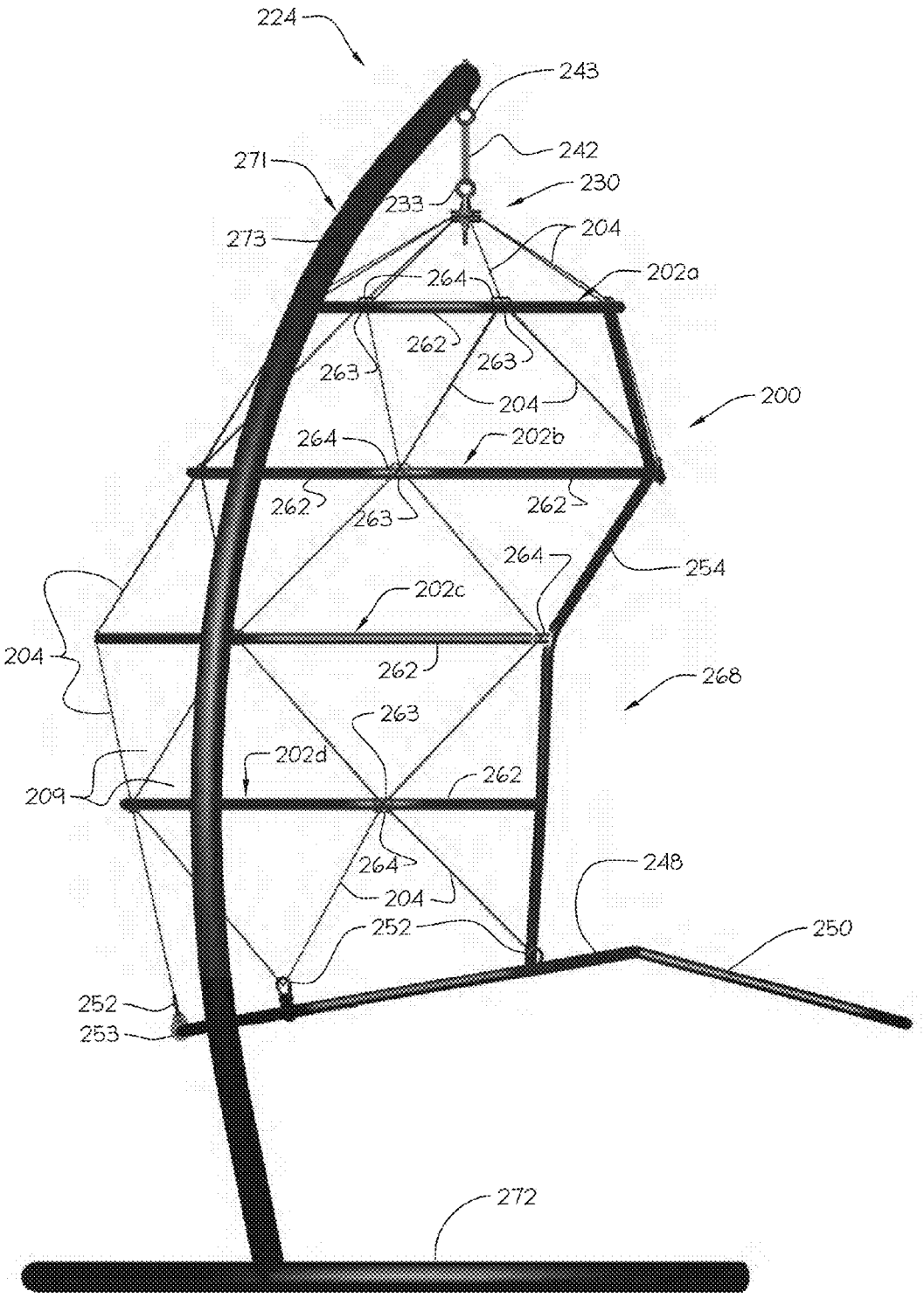
FIG. 8 is a side view of the illustrative hanging structure and support frame of FIG. 7.
Figure 9:
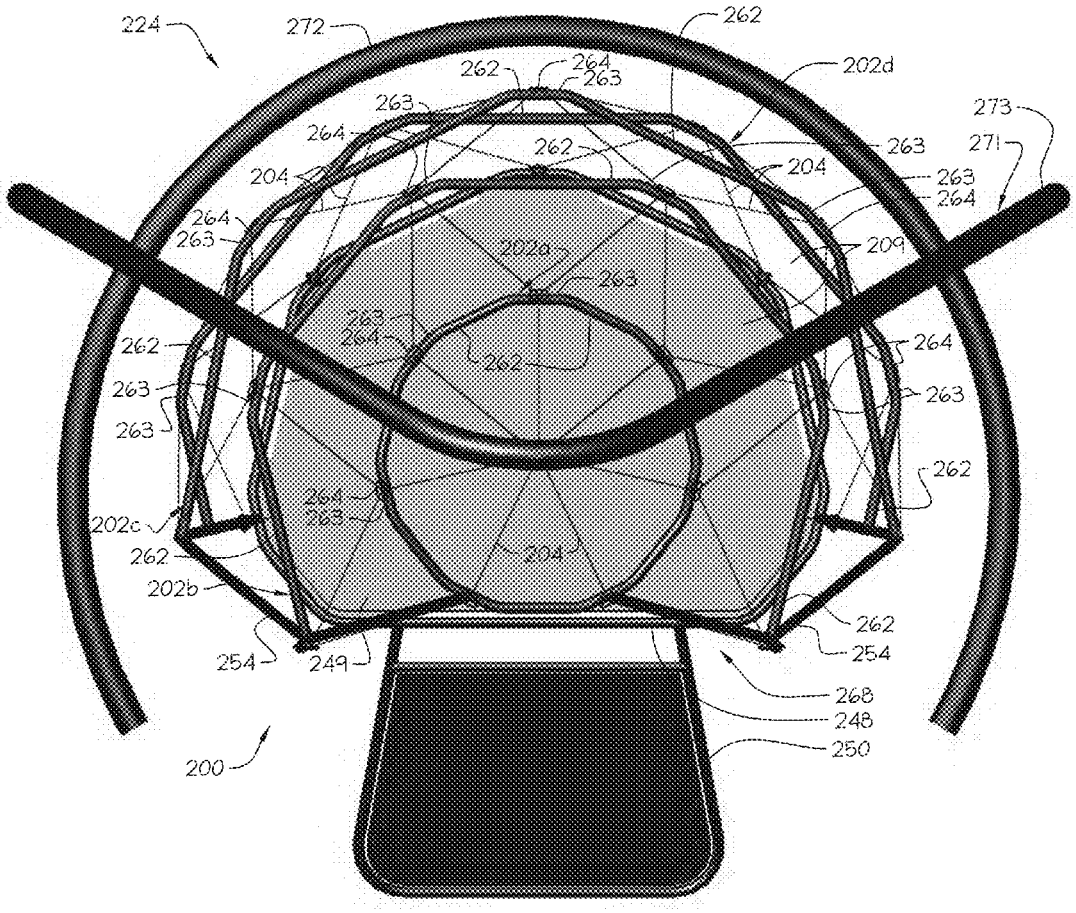
FIG. 9 is a top view of the illustrative hanging structure and support frame of FIG. 7.
Figure 10:
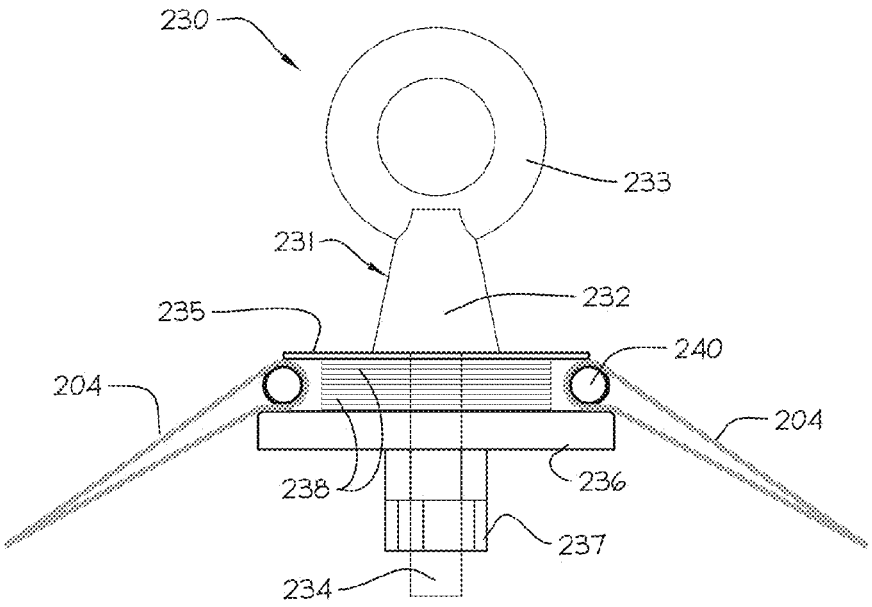
FIG. 10 is a sectional view of a typical suspension assembly which is suitable for suspending the hanging structures from a support frame.
Figure 11:
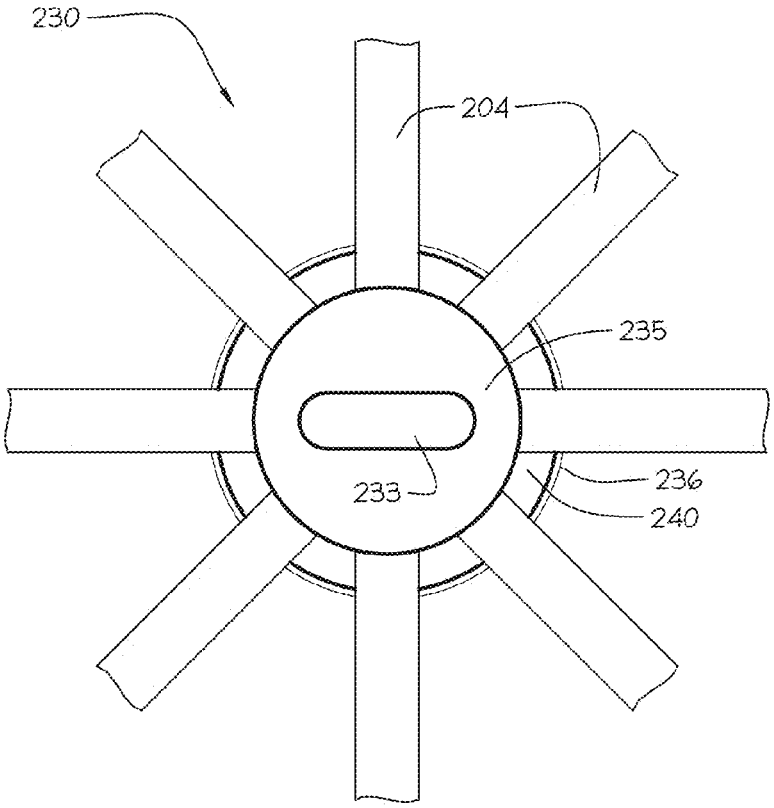
FIG. 11 is a top view of the typical suspension assembly of FIG. 10.

Referring next to FIGS. 7-14 of the drawings, an illustrative chair embodiment of the hanging structure is generally indicated by reference numeral 224. In the hanging structure 224, elements which are analogous to the respective elements of the hanging structure 124 that was heretofore described with respect to FIGS. 1A-6A are designated by the same numeral in the 201-299 series in FIGS. 7-14. In some embodiments, the hanging structure 224 may include a support frame 271 from which the structure frame 200 is suspended. The support frame 271 may include a support frame base 272. At least one suspension frame member 273 may be upward-standing from the support frame base 272. A suspension cable 242 may suspend the structure frame 200 from the suspension frame member 273 via a suspension bolt 243. A suspension assembly 230 may attach the structure frame 200 to the suspension cable 242. As illustrated in FIGS. 10 and 11, in some embodiments, the suspension assembly 230 may include an eyebolt 231 having an eyebolt body 232. An eye 233 may be provided on the eyebolt body 232. An elongated eyebolt shaft 234 may extend downwardly from the eyebolt body 232. An eyebolt flange 235 may be provided on the eyebolt shaft 234 at the eyebolt body 232. A bearing washer 236 may be provided on the eyebolt shaft 234 in spaced-apart relationship to the eyebolt flange 235. Multiple stacked spacer washers 238 may be sandwiched between the eyebolt flange 235 and the bearing washer 236.

A tension ring 240 may be provided between the eyebolt flange 235 and the bearing washer 236 in encircling relationship to the spacer washers 238. Multiple tensile members 204 may be attached to the tension ring 240 in spaced-apart relationship to each other around the circumference of the tension ring 240. Each tensile member 204 may be attached to the tension ring 240 by looping each tensile member 204 through the tension ring 240 and stitching or otherwise attaching the looped end to the main segment of the tensile member 204.

Figure 7:
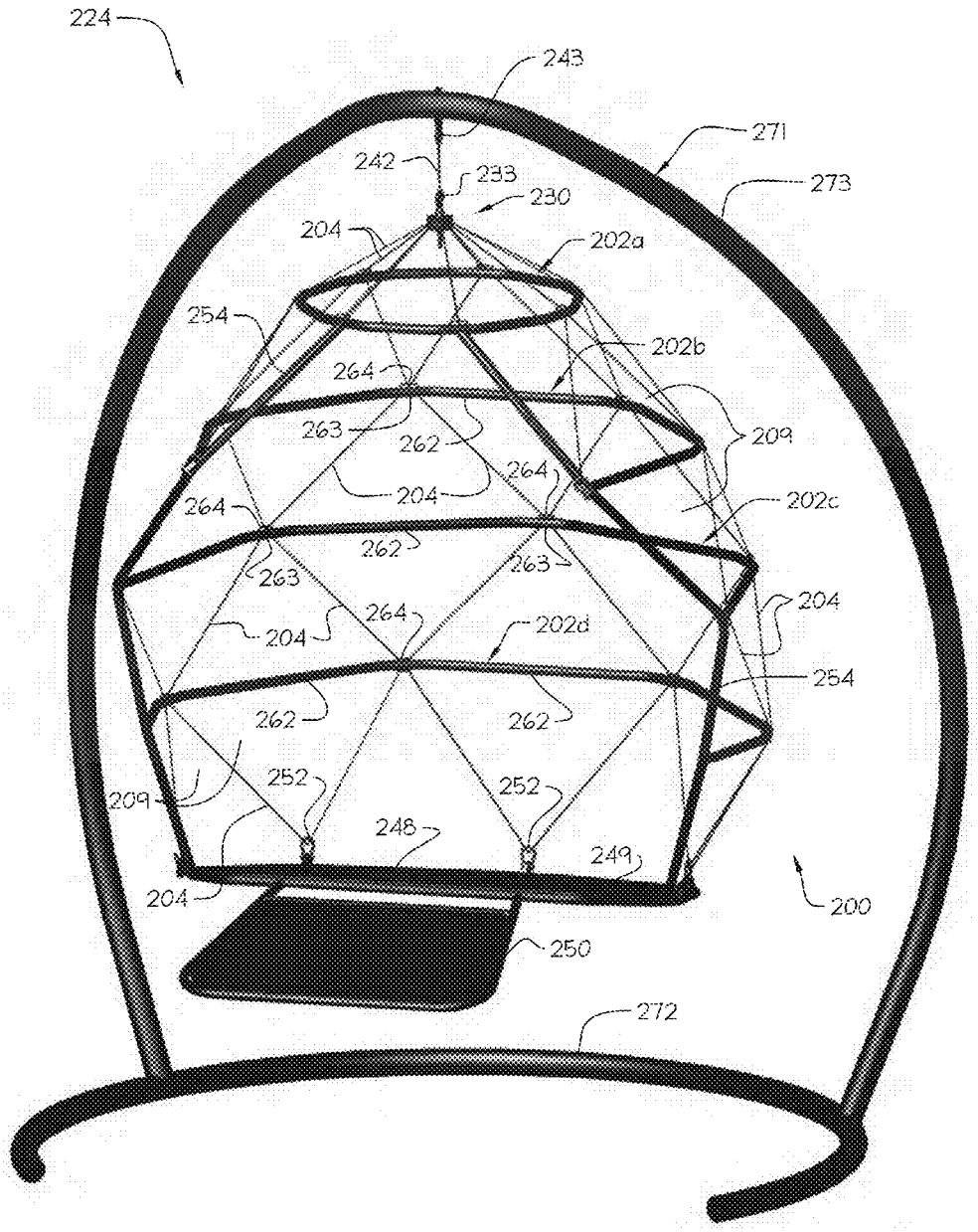
FIG. 7 is a front perspective view of an illustrative chair embodiment of the hanging structures having zome geometry, with the hanging structure suspended from a typical support frame.

As illustrated in FIGS. 7-9, in some embodiments, the hanging structure 224 may include an uppermost compressive member 202*a*, an upper compressive member 202*b*, a middle compressive member 202*c* and a lower compressive member 202*d*. A base frame member 248 may be disposed beneath the lower compressive member 202*d*. As illustrated in FIGS. 7-9, in some embodiments, a base panel 249 may be supported by the base frame member 248. A base panel extension 250 may extend from the base frame member 248 in some embodiments. The tensile members 204 may connect the uppermost compressive member 202*a* to the tension ring 240 (FIG. 10) of the suspension assembly 230, the upper compressive member 202*b* to the uppermost compressive member 202*a*, the middle compressive member 202*c* to the upper compressive member 202*b*, the lower compressive member 202*d* to the middle compressive member 202*c* and the base frame member 248 to the lower compressive member 202*d*. The tensile members 204 may be attached to each of the compressive members 202 according to any suitable attachment technique which is known by those skilled in the art.

Figure 12:
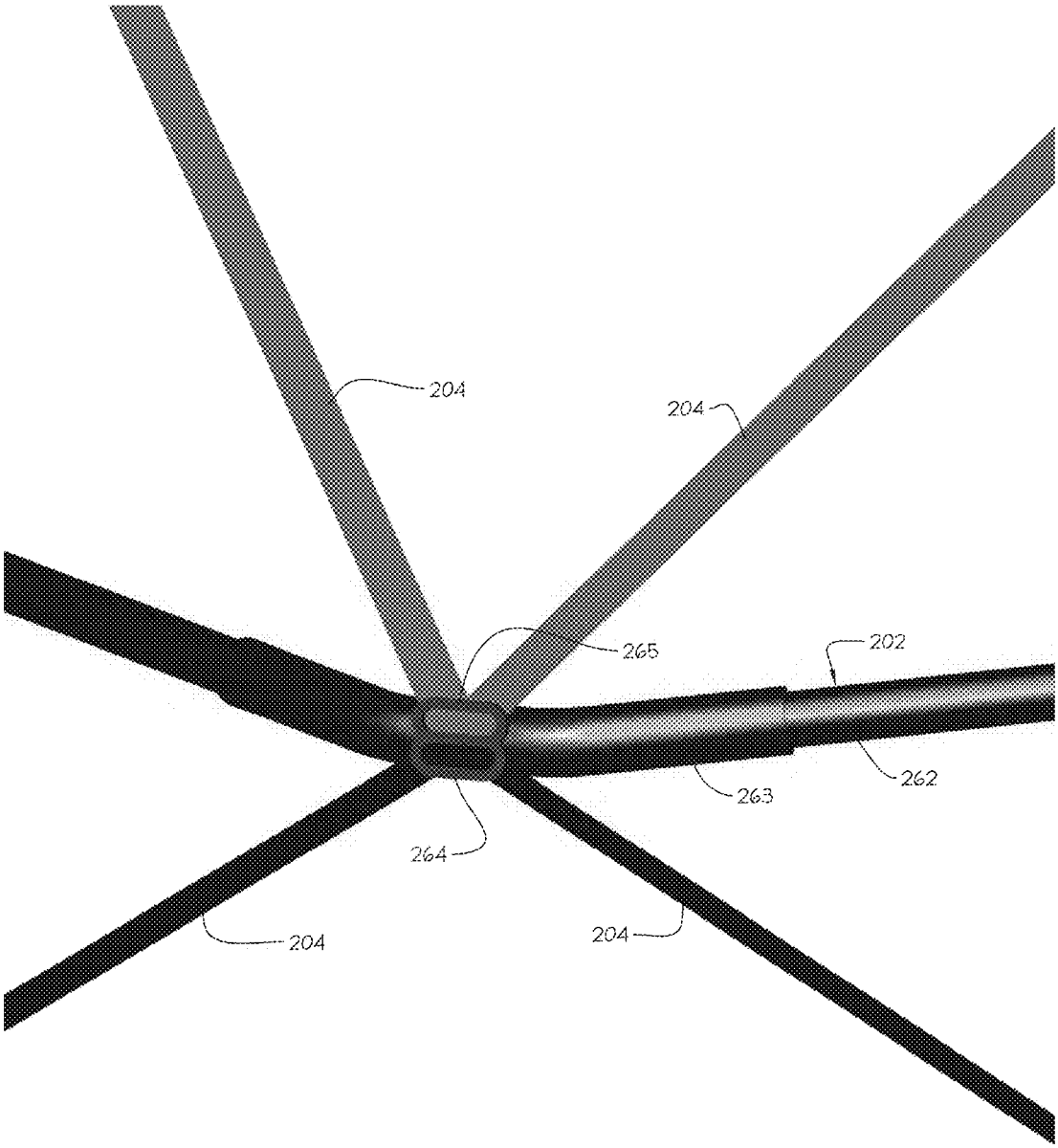
FIG. 12 is an enlarged sectional view of a typical node and node plate which secures multiple tensile members to multiple compressive members of the hanging structure.
Figure 13:
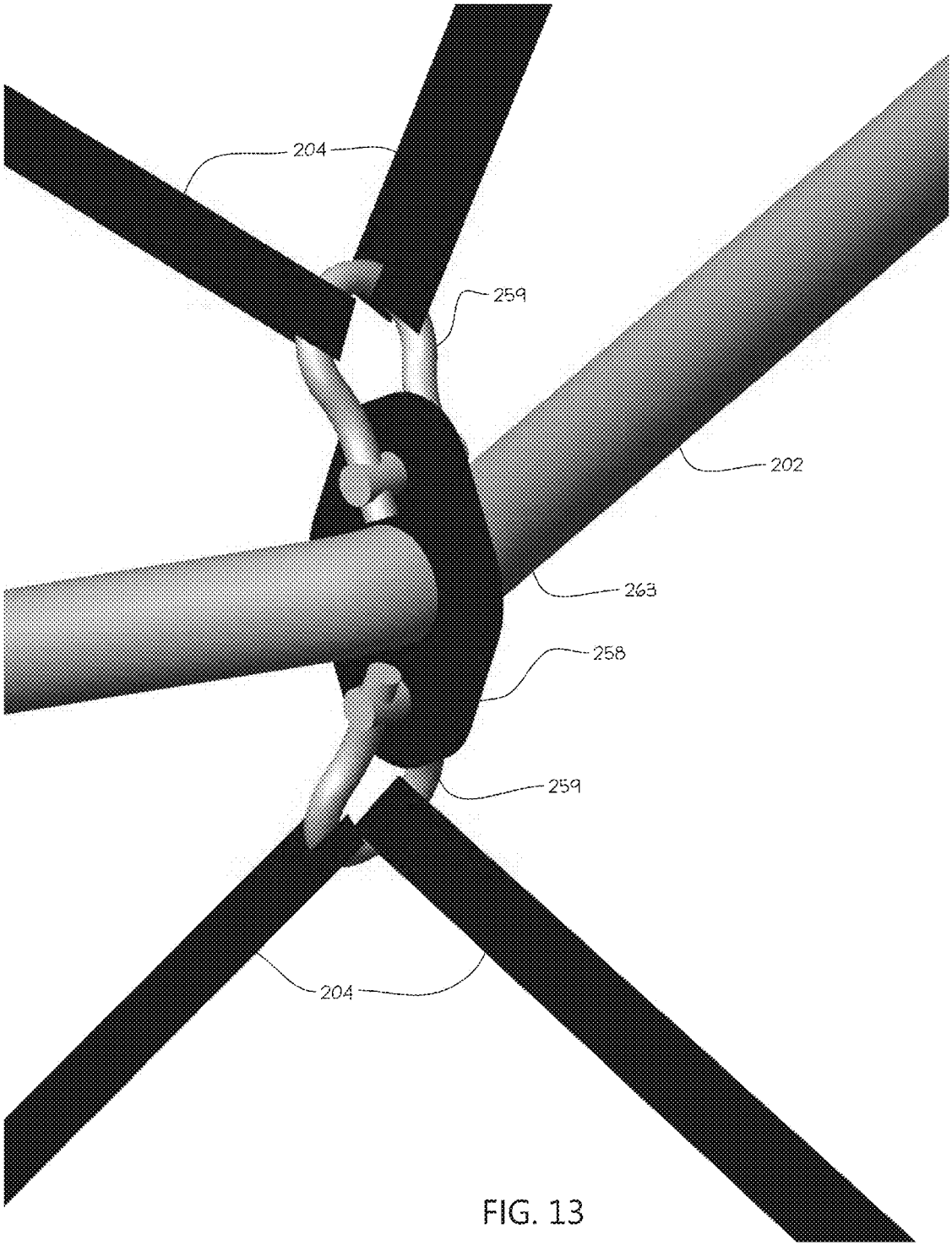
FIG. 13 is an enlarged sectional view of an alternative node plate with shackles which attach the tensile members to the node plate and compressive members.

As illustrated in FIG. 12, in some embodiments, each of the compressive members 202 may be fabricated of multiple, elongated, tubular frame elements 262. A moment resisting node 263 may connect adjacent tubular frame elements 262 in end-to-end relationship to each other. A node plate 264 having a pair of upper and lower node plate slots 265 may be fastened, welded and/or otherwise attached to each node 263. Accordingly, each tensile member 204 may be extended through a corresponding node plate slot 265 in the node plate 264. As illustrated in FIG. 13, in some alternative embodiments, a node bracket 258 may be provided on each node 263 of the compression member 202. A pair of upper and lower shackles 259 may be attached to the node bracket 258. Accordingly, a pair of adjacent tensile members 204 may be attached to each of the upper and lower shackles 259.

Figure 14:
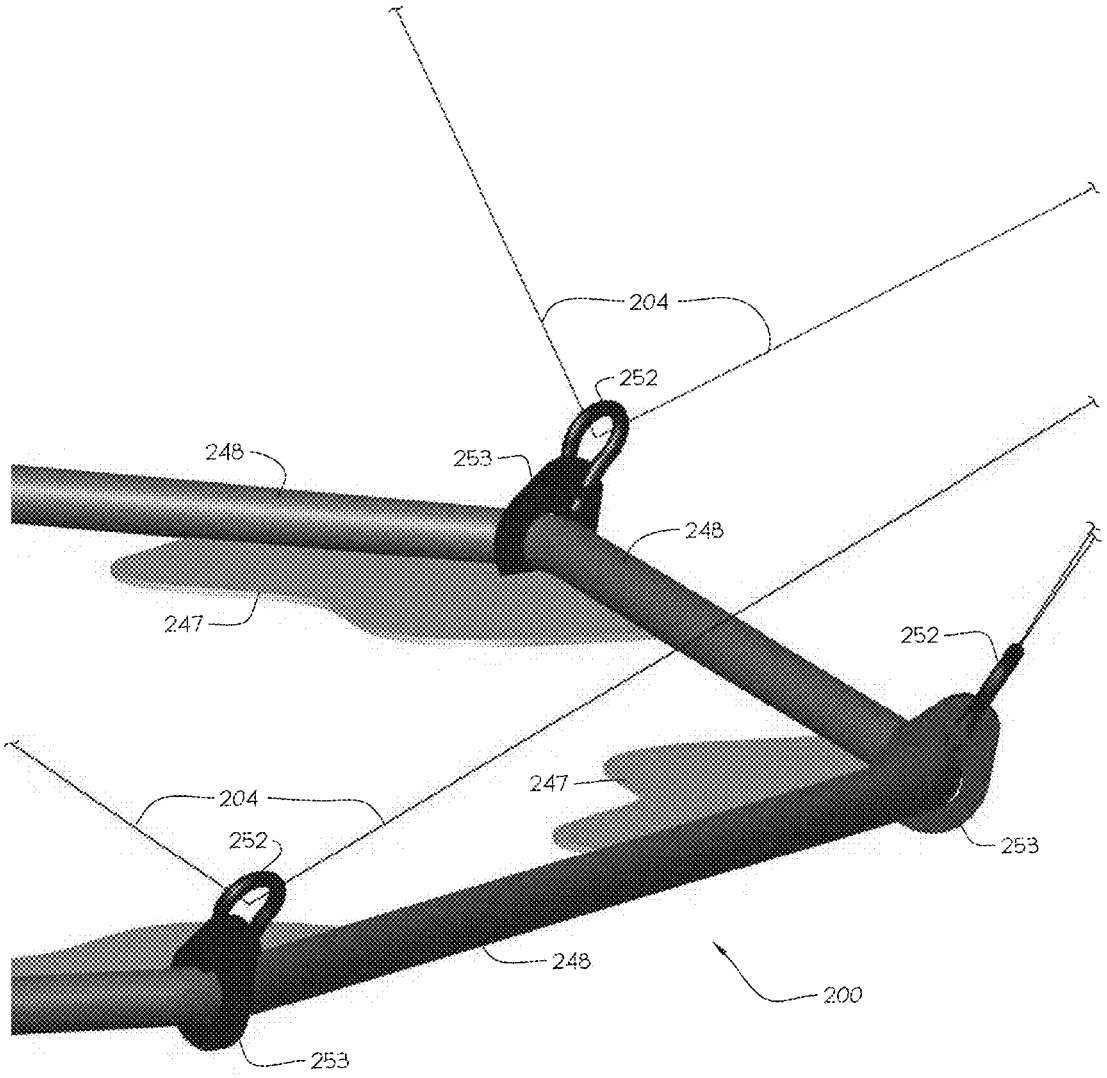
FIG. 14 is a sectional perspective view of a typical base frame member and multiple base shackles and shackle node plates attaching the tensile members to the base frame member.

The tensile members 204 may be attached to the base frame member 248 according to any suitable technique which is known by those skilled in the art. As illustrated in FIG. 14, in some embodiments, multiple eye hook plates 253 may be provided on the base frame member 248 at spaced-apart intervals to each other. A base eye hook or shackle 252 may extend from each eye hook plate 253. Each tensile member 204 may extend through a corresponding base eye hook or shackle 252. In some embodiments, a base plate 247 may be attached to the base frame member 248 according to any suitable technique. The base plate 247 allows the base floor 249 (not shown) to be located inside the base frame member 248.

As illustrated in FIGS. 7-9, in some embodiments, the uppermost compressive member 202*a* may be continuous while the upper compressive member 202*b*, the middle compressive member 202*c* and the lower compressive member 202*d* may be elongated, discontinuous and generally C-shaped. The respective ends of the upper compressive member 202*b*, the middle compressive member 202*c* and the lower compressive member 202*d* may terminate on a pair of spaced-apart front frame members 254, the lower ends of which terminate at the base frame member 248 and the upper ends of which terminate at the uppermost compressive member 202*a*. A structure opening 268 may be formed by and between the front frame members 254.

In exemplary application, the hanging structure 224 may be used as a chair. The base panel 249 may be rigid (wood, plastic metal or the like) or flexible (fabric or the like) and may be slanted in some embodiments for enhanced ergonomics. A backrest (not illustrated) may be provided on the compressive members 202 opposite the structure opening 268 to support a the back of a user as the user sits on the base panel 249. In some embodiments, the backrest may be adjustable for different angles of inclination using simple hinge and adjustable length tension members known by those skilled in the art. In some embodiments, accessories such as retractable foot/leg rests, armrests, cup holders, canopies, sunshades, cushions or the like may be fitted to the suspension assembly 230.

Figure 15:
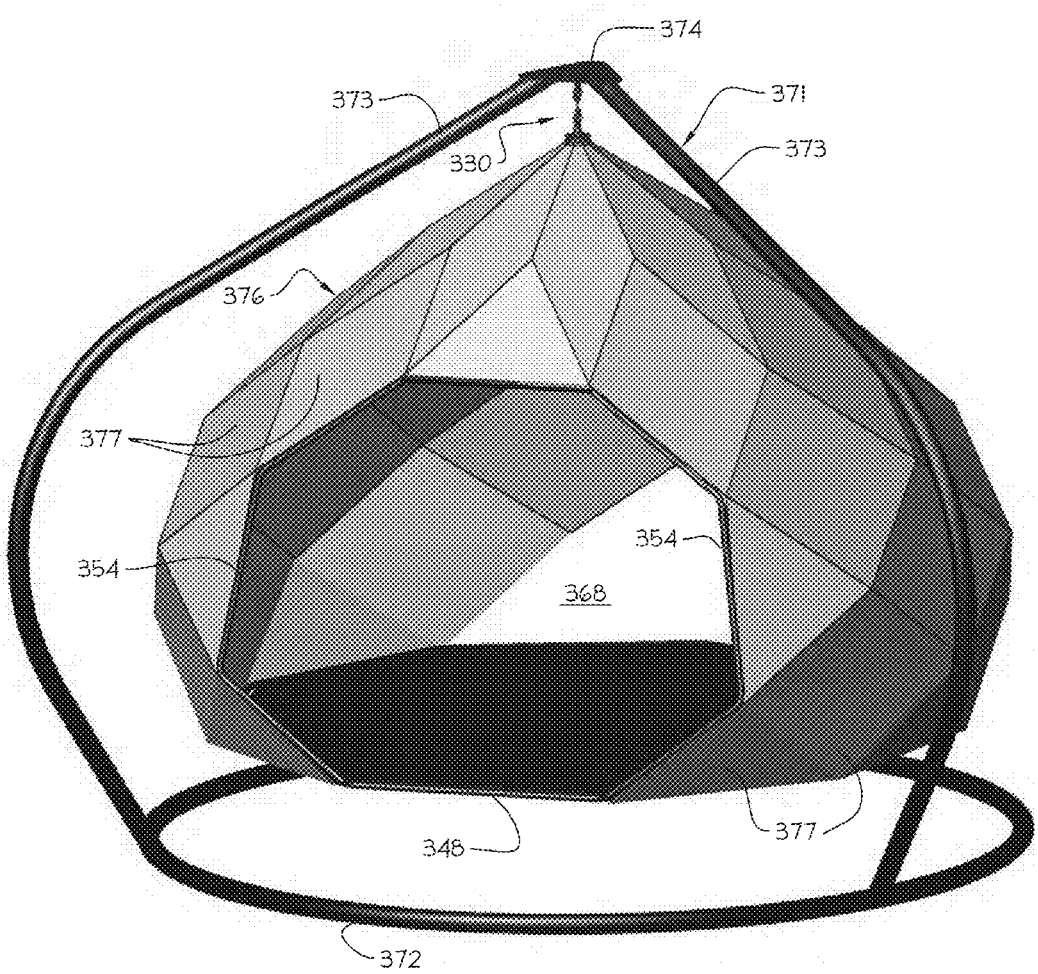
FIG. 15 is a front perspective view of an illustrative lounge/bed embodiment of the hanging structures.
Figure 16:
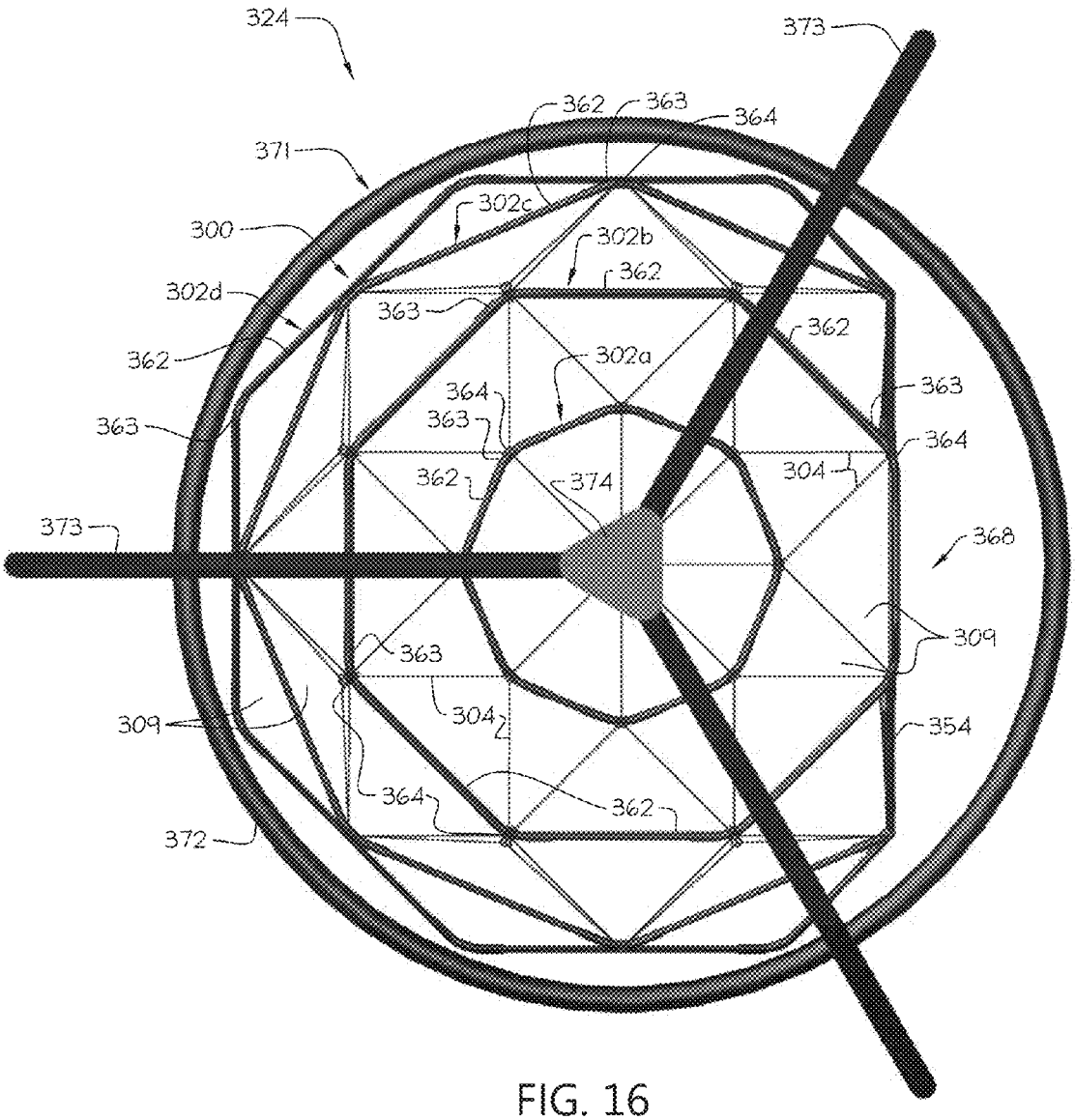
FIG. 16 is a top view of a frame of the hanging structure illustrated in FIG. 15.
Figure 17:
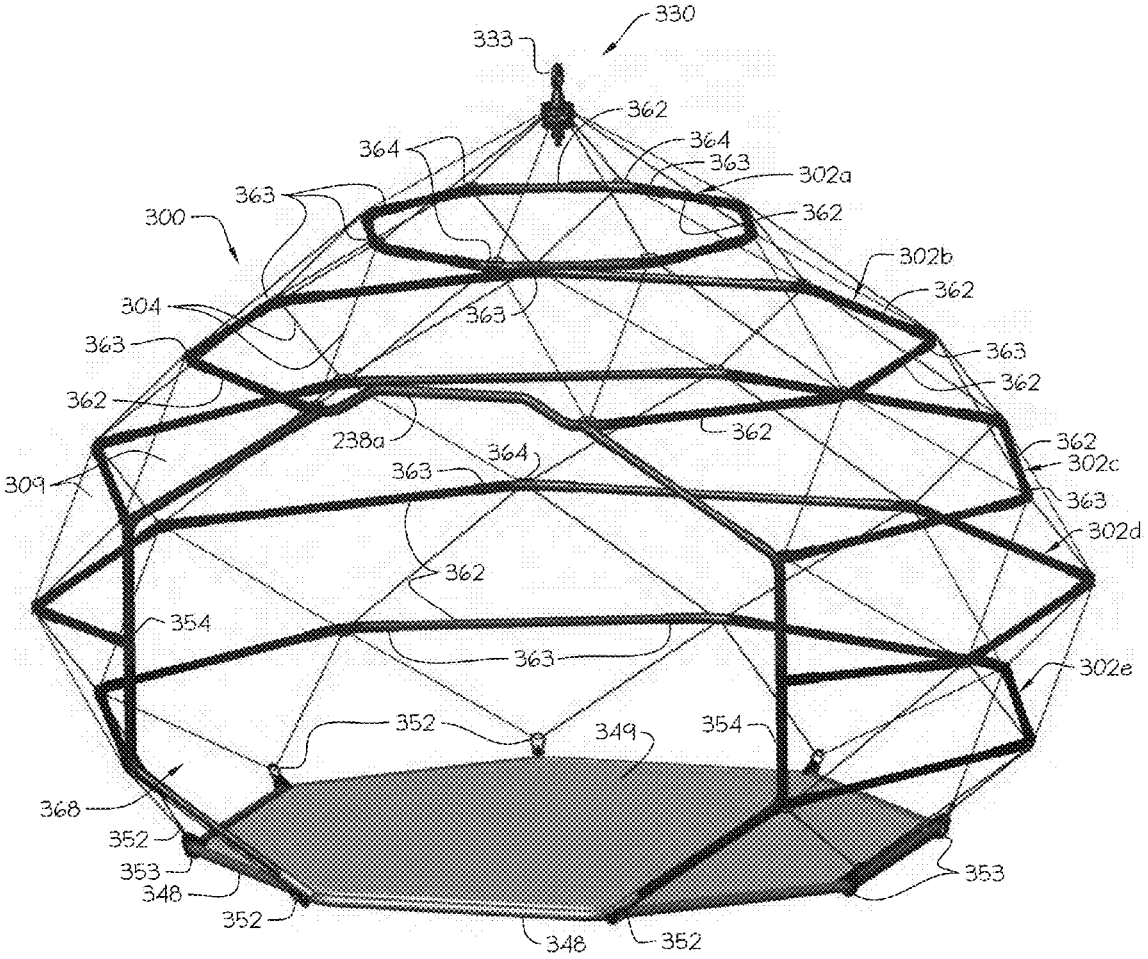
FIG. 17 is a front perspective view of the frame of the hanging structure illustrated in FIG. 15.
Figure 18:
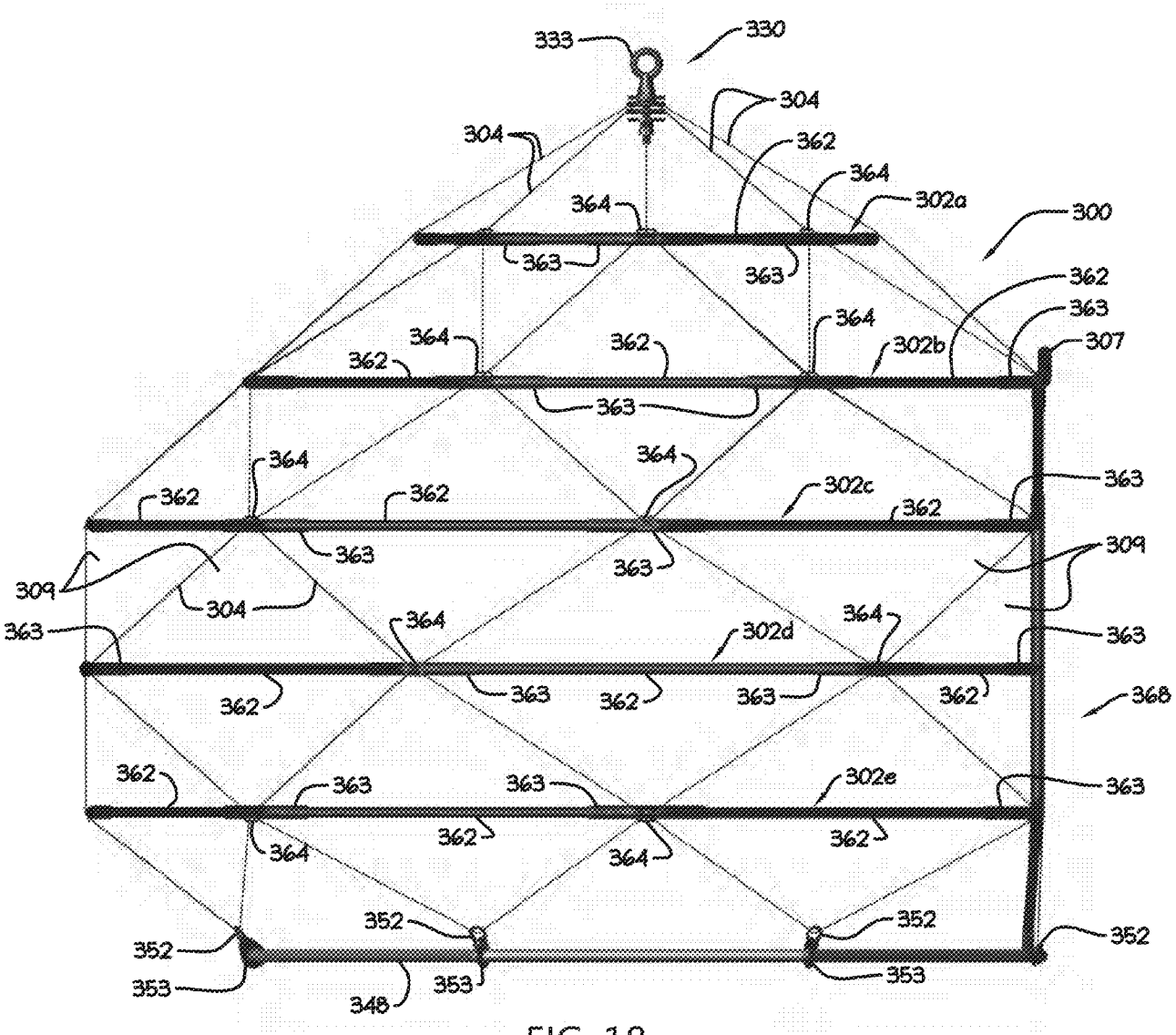
FIG. 18 is a side view of the frame of the hanging structure illustrated in FIG. 15.
Figure 19:
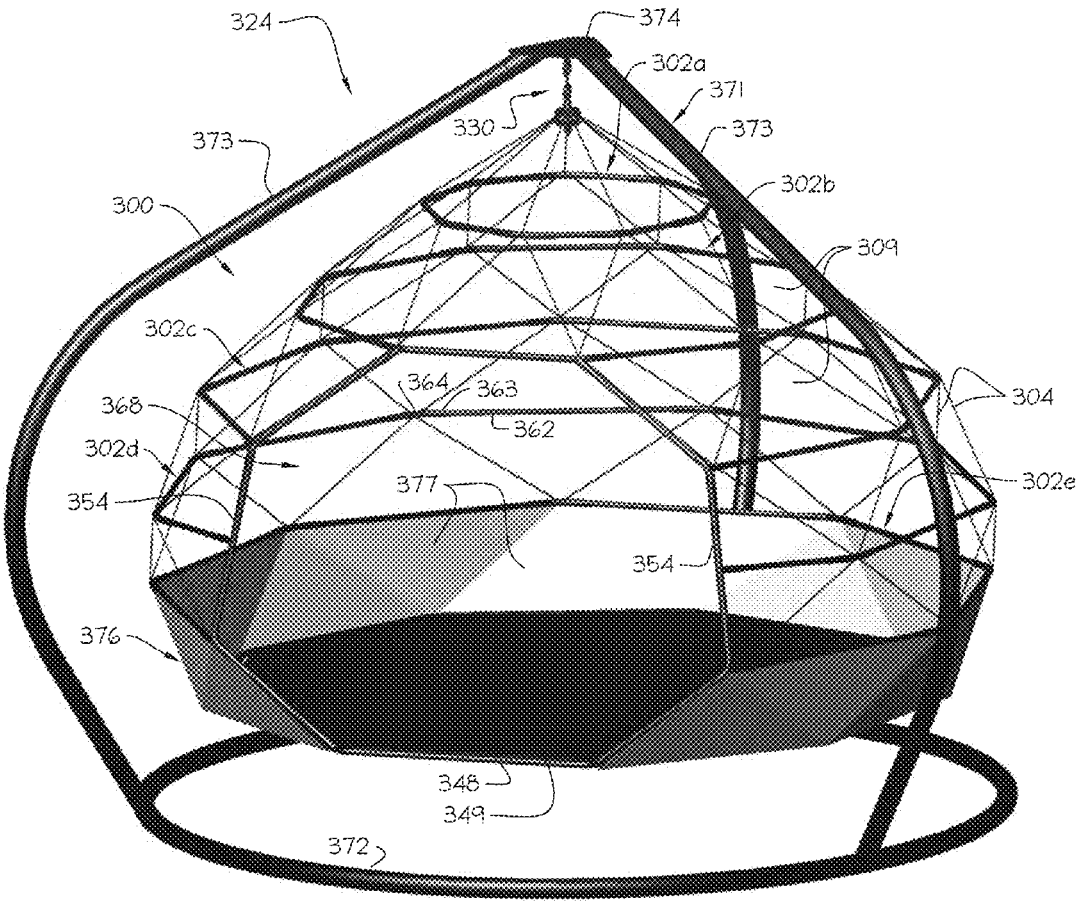
FIG. 19 is a front view of the frame of the hanging structure illustrated in FIG. 15 with a portion of the structure canopy on a lower portion of the frame.
Figure 20:
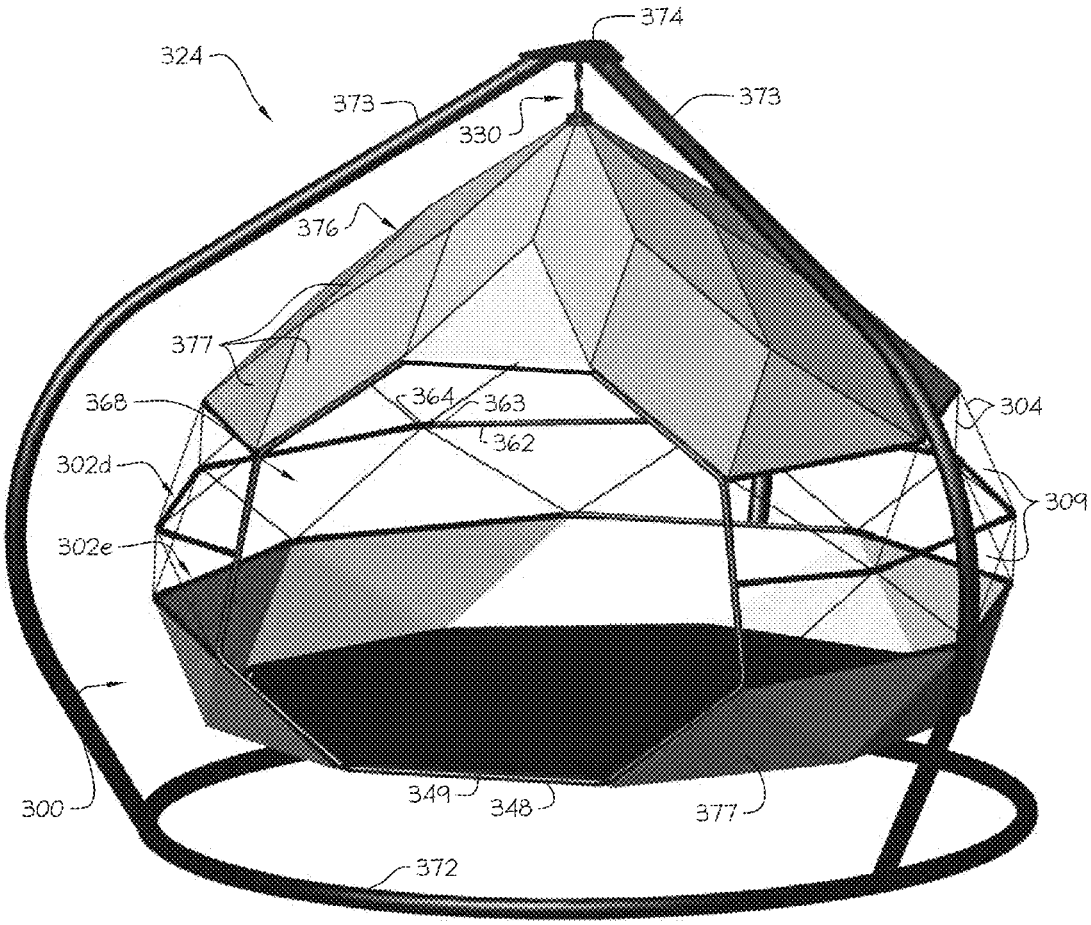
FIG. 20 is a front view of the frame of the hanging structure illustrated in FIG. 15 with a portion of the structure canopy on lower and upper portions of the frame.

Referring next to FIGS. 15-20 of the drawings, an illustrative love seat/lounge embodiment of the hanging structure is generally indicated by reference numeral 324. In the hanging structure 324, elements which are analogous to the respective elements of the hanging structure 124 that was heretofore described with respect to FIGS. 1A-6A are designated by the same numeral in the 301-399 series in FIGS. 15-20. As illustrated in FIGS. 16-18, in some embodiments, the structure frame 300 of the hanging structure 324 may include an uppermost compressive member 302*a*, an upper compressive member 302*b*, a middle compressive member 302*c*, a lower compressive member 302*d* and a lowermost compressive member 302*e*. A structure canopy 376 may be provided on the structure frame 300. The structure canopy 376 may include multiple canopy panels 377 which correspond to the respective facets of the hanging structure 324. As illustrated in FIG. 15, in some embodiments, the structure canopy 376 may cover substantially the entire structure frame 300. As illustrated in FIG. 19, in other embodiments, the structure canopy 376 may cover only the lower portion of the structure frame 300. In still other embodiments, the structure canopy 376 may cover only the upper portion of the structure frame 300 or may cover the lower and upper portions of the structure frame 300, as illustrated in FIG. 20.

A support frame cap 374 may connect the suspension frame members 373 to each other at the top of the support frame 371. A suspension assembly 330 may suspend the structure frame 300 from the support frame cap 374.

In exemplary application, the hanging structure 324 may be used as lounge furniture or as a bed. In some embodiments, the hanging structure 324 may include interchangeable structure canopies 376, sunshade, cushions, indoor/outdoor applications, hinged doors or the like.

Figure 21:
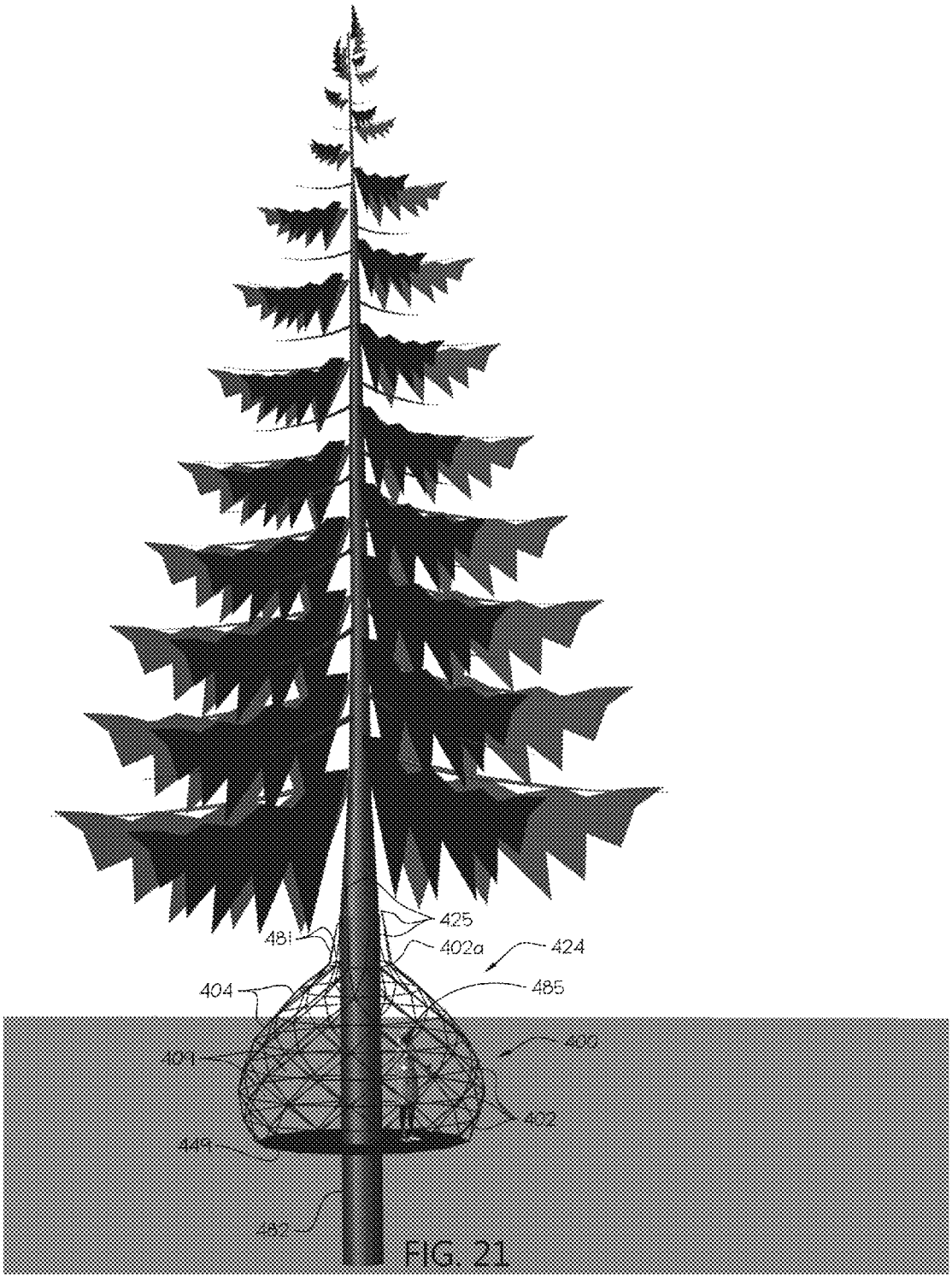
FIG. 21 is a front perspective view of an illustrative tree house embodiment of the hanging structures deployed on a tree.

Referring next to FIG. 21 of the drawings, an illustrative tree house embodiment of the hanging structures is generally indicated by reference numeral 424. The structure frame 400 of the hanging structure 424 may be secured to a tree 482 using typical treehouse attachment bolts 425 (also known as TAB's) and cables 481, or other support according to the knowledge of those skilled in the art. Using the tree 482 or other support as the center support anchor, an opening (not illustrated) may be provided in the base panel 449 to facilitate passage of the tree 482 through the hanging structure 424. In some embodiments, a trap door (not illustrated) provides a person 485 access to the interior of the hanging structure 424 from below.

The hanging structure 424 may be fabricated with multiple independent anchor points. Treehouse attachment bolts 425 can be placed in the tree 482 anywhere above the hanging structure 424, with cables 481 connecting the anchors 425 to the top ring of the structure frame 402*a*. Therefore, the structure 424 need not dictate the location of the attachment bolts 425, rather the anchoring points can be placed to avoid limbs, knots, or other undesirable location. Further, locating the attachment bolts 425 at varied heights on the tree 482 above the structure 424 ensures the tree will not be girdled and weakened by the anchors. The structure frame 400 may include an uppermost member 402*a* which is strengthened to resist tension and bending moment forces, and becomes the interface between the tree anchors 425 and cables 481 and the zome geometry structural suspension system of the hanging structure 424.

Referring again to FIG. 5, the tension ring 240 (FIG. 10) on the suspension assembly 230 of the hanging structure 424 at level 0 may be eliminated. Instead, level 1 becomes the tension ring 240. The tension ring 240 may be designed to receive tensile members 481 from the anchors above (typically steel wire rope), and also receive the typical tensile members 404 from below. The level 1 tension ring 240 may be centered around the tree 482 and may incorporate pads (not illustrated) to soften any impact that may occur during swaying of the tree 482. At level 6 (FIG. 5), corresponding to the floor level of the hanging structure 424, the compressive member 402 may be reinforced to resist compressive, tensile, bending and torsion forces. An opening (not illustrated) may be provided in the floor to allow for pass-thru of the tree 482. Pads (not illustrated) may provide protection from impact caused by tree movement. Properly designed and adjusted, the hanging structure 424 may sway in perfect resonance with the tree 482 and may not impact at the top or bottom rings or compressive members 402.

As the tree 482 grows, the anchors which attach the structure frame 400 to the tree 482 may be consumed by the tree 482. This is considered typical in treehouse construction, and may be designed into the life-span of the hanging structure 424. This consumption of the anchors may result in a stronger anchor until the point where the tree 482 begins to consume either the support cable or the hanging structure 424 itself, however As the tree 482 grows, the hanging structure 424 need not be consumed since the horizontal members 402 may be fabricated with a larger diameter than the trunk of the tree 482 and the pads may be adjustable, allowing substantial tree growth. When the tree 482 grows to the size of the horizontal members 402, the entire hanging structure 424 may be disassembled and re-used on an appropriately-sized tree 482. Therefore, at the end of the life-cycle of the hanging structure 424, the tree 482 remains healthy with anchors embedded within the growth, and the hanging structure 424 is recycled.

The hanging structure 424 may be lightweight and the structural connections in the hanging structure 424 may be dynamic, or designed to sway with any tree movement. The hanging structure 424 may be fabricated without any rigid connections between the tree 482 and the hanging structure 424. In some applications, the hanging structure 424 may also double as a safety enclosure.

The amount of mass which may be removed by limbing the tree 482 may be equivalent to the additional mass of the hanging structure 424 such that the tree 482 assumes little change in mass, which may be concentrated at the centerline of the tree 482.

In some embodiments, independent anchors above with wire rope connected to the tension ring of the hanging structure 424 may allow the anchors to move independently during tree movement. Since trees resist wind forces via 2 main systems—swaying and torsional rotation—the anchors may not interfere with or impede any torsion of the tree trunk itself.

With a cover or canopy removed from the structure frame 400, wind passes easily through the hanging structure 424, providing little (or less) wind sail than the branches that were removed. With the cover or canopy deployed on the structure frame 400, the round shape of the hanging structure 424 deflects much of the wind forces which impinge against the canopy. In embodiments in which the hanging structure 424 lacks large flat facets has a symmetric shape, there is no large "sail effect" from wind loads as compared with a conventional rectangular or square-shaped treehouse.

In some applications, the hanging structure 424 may be used as a temporary treehouse without requiring that the anchors be drilled into the tree 482. Using webbing or cable, a weave can be created to secure the level 1 tension ring to the trunk of the tree 482 in a manner which is similar to "Chinese fingercuffs" or the log pulling chokers that loggers use in forestry operations. Several lengths of webbing or cable can be wrapped around the tree 482, interweaving with each other. Then, when gravitational force is exerted on the weave from the weight of the hanging structure 400 below, the weave tightens and cinches itself on the trunk of the tree 482. This may be considered a more temporary installation since the girdling and restriction of the weave could harm the tree 482 over longer periods of time. This type of installation may be appropriate in scientific research projects or other short-term uses.

Figure 22:
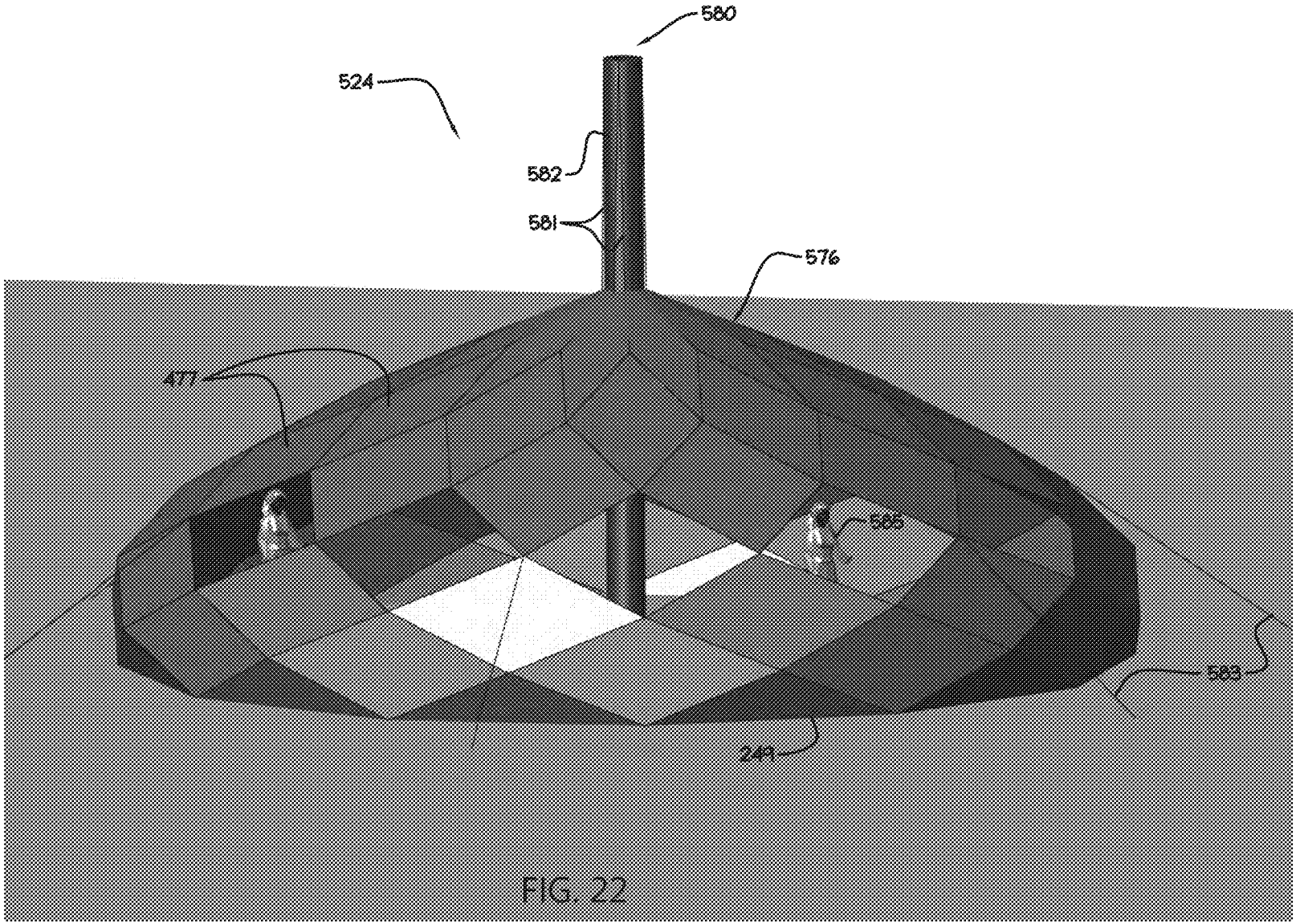
FIG. 22 is a front perspective view of an illustrative event zome/awning space embodiment of the hanging structures deployed in a lowered position on a support.
Figure 23:
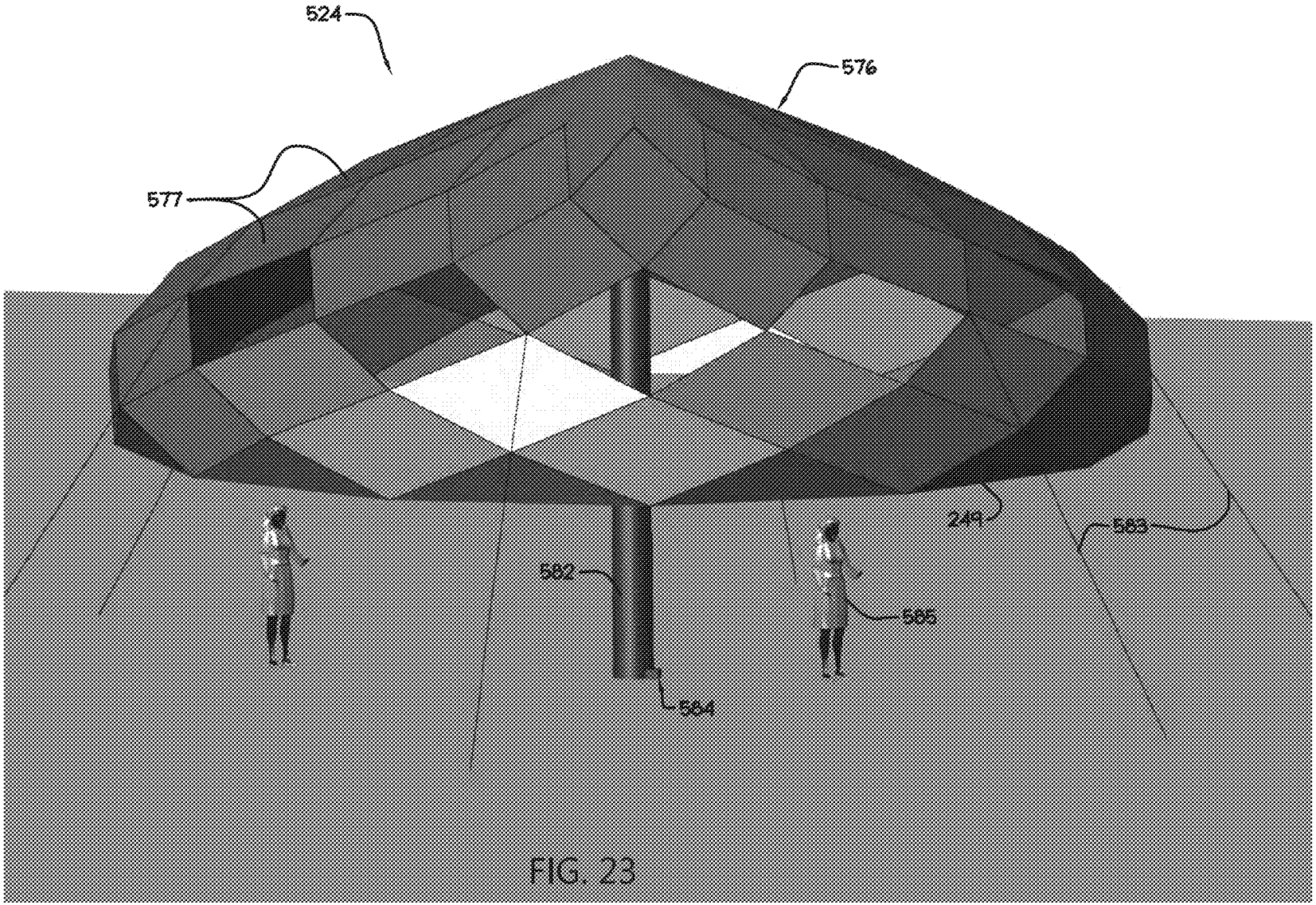
FIG. 23 is a front perspective view of the illustrative hanging structure of FIG. 22 deployed in a raised position on the support.

Referring next to FIGS. 22 and 23 of the drawings, an illustrative event zome/awning space embodiment of the hanging structure is generally indicated by reference numeral 524. In the hanging structure 524, elements which are analogous to the respective elements of the hanging structure 124 that was heretofore described with respect to FIGS. 1A-6A are designated by the same numeral in the 501-599 series in FIGS. 22 and 23. The hanging structure 524 may be supported by a pole 582 or other support. The hanging structure 524 may be sufficiently sized to accommodate at least one person 585. As illustrated in FIG. 22, in some embodiments, a pulley system 580 may include multiple cables 581 which are attached to the structure frame 500 of the hanging structure 524. A control box 584 (FIG. 23) may interface with the pulley system 580 according to the knowledge of those skilled in the art to selectively lower (FIG. 22) and raise (FIG. 23) the hanging structure 524 on the tree 582. In some embodiments, multiple anchor lines 583 may anchor the hanging structure 524 to the ground. The pole 582 may also be a telescoping pole system, whereby the structure 524 need not have a hole in the top for the pole 582 to extend through. Instead, the structure 524 can be raised and lowered by the pole 582 telescoping up and down.

Using a pole 582 or other support as the center support structure but eliminating the base panel 549 results in a tent covering. In the raised position (FIG. 23), the lightweight, cool looking shade structure can be braced against wind with the anchor lines 583 which may be length-adjustable. The control box 584 may be used to selectively operate the raising and lowering of the hanging structure 524 and may be manual or power-operated.

In embodiments in which a base panel 549 is included at the bottom of the structure frame, the hanging structure 524 may provide a habitable space. The hanging structure 524 may be completely supported from above, via the support 582. In some embodiments, the hanging structure 524 may be customized to allow for specific uses such as a personal yoga zome, a children's play space, an aerial acrobatic art zome, a simulated beehive, a lamp shade, etc.

These and other advantages of the invention will be further understood and appreciated by those skilled in the art by reference to the following written specification, claims and appended drawings.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A hanging structure suspended from a suspension assembly for forming a scalable zome design, the structure comprising:

a structure frame suspended from the suspension assembly from a single support point, the structure frame having a substantially convex polyhedron shape, the structure frame comprising:

at least one facet, at least one level and a ratio;

a plurality of compressive members being disposed to align along a substantially horizontal alignment on the structure frame and configured to absorb a compressive force, the plurality of compressive members further being disposed to delineate each of the at least one level; and a plurality of tensile members carrying the plurality of compressive members, the plurality of tensile members being disposed to align along a substantially vertical or diagonal alignment on the structure frame.

2. The hanging structure of claim 1 further comprising a support frame, and wherein the structure frame is carried by the support frame.

3. The hanging structure of claim 2 further comprising a suspension assembly carried by the support frame and wherein the structure frame is carried by the suspension assembly.

4. The hanging structure of claim 3 wherein the suspension assembly comprises an eyebolt carried by the support frame and a tension ring carried by the eyebolt, and wherein the plurality of tensile members is carried by the tension ring.

5. The hanging structure of claim 4 wherein the plurality of compressive members comprises an uppermost compressive member beneath the tension ring, an upper compressive member beneath the uppermost compressive member, a middle compressive member beneath the upper compressive member, a lower compressive member beneath the middle compressive member and a tension resisting base frame member beneath the lower compressive member.

6. The hanging structure of claim 2 wherein the support frame comprises a support frame base and a suspension frame member upward-standing from the support frame base, and wherein the structure frame is carried by the suspension frame member.

7. The hanging structure of claim 1 wherein each of the plurality of compressive members comprises a plurality of tubular frame elements and a plurality of moment resisting nodes connecting the frame elements, the plurality of moment resisting nodes defining attachment points between the plurality of compressive members and the plurality of tensile members.

8. The hanging structure of claim 7 further comprising a node plate carried by the plurality of nodes, respectively, each of the node plates having a pair of node plate slots accommodating a pair of the tensile members, respectively.

9. A hanging structure for forming a scalable zome design, the structure comprising:

a suspension assembly comprising a tension ring;

a structure frame suspended from the tension ring, the structure frame having a substantially convex polyhedron shape, the structure frame comprising:

at least one facet, at least one level and a ratio;

a plurality of compressive members being disposed to align along a substantially horizontal alignment on the structure frame, the plurality of compressive members further being disposed to delineate each of the at least one level, the plurality of compressive members comprising a plurality of rigid horizontal rings configured to absorb a compressive force; and a plurality of tensile members carrying the plurality of compressive members, the plurality of tensile members being disposed to align along a substantially vertical or diagonal alignment on the structure frame.

10. The hanging structure of claim 9 further comprising a support frame, and wherein the structure frame is carried by the support frame.

11. The hanging structure of claim 10 wherein the support frame comprises a support frame base and a suspension frame member upward-standing from the support frame base, and wherein the structure frame is carried by the suspension frame member.

12. The hanging structure of claim 9 wherein the plurality of tensile members is carried by the tension ring.

13. The hanging structure of claim 12 wherein the plurality of compressive members comprises an uppermost compressive member beneath the tension ring, an upper compressive member beneath the uppermost compressive member, a middle compressive member beneath the upper compressive member, a lower compressive member beneath the middle compressive member and a tension resisting base frame member beneath the lower compressive member.

14. The hanging structure of claim 9 wherein each of the plurality of compressive members comprises a plurality of tubular frame elements and a plurality of moment resisting nodes connecting the frame elements, the plurality of moment resisting nodes defining attachment points between the plurality of compressive members and the plurality of tensile members.

15. The hanging structure of claim 14 further comprising a node plate carried by the plurality of nodes, respectively, each of the node plates having a pair of node plate slots accommodating a pair of the tensile members, respectively.

16. A hanging structure suspended from a suspension assembly for forming a scalable zome design, the structure comprising:

a structure frame suspended from the suspension assembly from a single support point, the structure frame having a substantially convex polyhedron shape, the structure frame comprising:

at least one facet, at least one level and a ratio;

a plurality of compressive members being disposed to align along a substantially horizontal alignment on the structure frame, the plurality of compressive members further being disposed to delineate each of the at least one level, the plurality of compressive members comprising a plurality of rigid horizontal rings configured to absorb a compressive force;

a plurality of tensile members carrying the plurality of compressive members, the plurality of tensile members being disposed to align along a substantially vertical or diagonal alignment on the structure frame, the plurality of tensile members comprising a plurality of cords configured to resist a tensile force, the plurality of tensile members being configured to intersect the plurality of compressive members at at least one moment resisting node; and at least one fastener joining the plurality of compressive members with the plurality of tensile members at the at least one moment resisting node.

17. The hanging structure of claim 16 further comprising a canopy carried by the structure frame.

18. The hanging structure of claim 16 wherein each of the plurality of compressive members comprises a plurality of tubular frame elements and the at least one node comprises a plurality of moment resisting nodes connecting the tubular frame elements, the plurality of moment resisting nodes defining attachment points between the plurality of compressive members and the plurality of tensile members.

19. The hanging structure of claim 18 further comprising a node plate carried by the plurality of nodes, respectively, each of the node plates having a pair of node plate slots accommodating a pair of the tensile members, respectively.

* * * * *